US011455948B2

(12) United States Patent
Yoon

(10) Patent No.: US 11,455,948 B2
(45) Date of Patent: Sep. 27, 2022

(54) ELECTRONIC DEVICE AND IMAGE DISPLAY METHOD OF ELECTRONIC DEVICE

(71) Applicant: Samsung Electronics Co., Ltd., Gyeonggi-do (KR)

(72) Inventor: Young Il Yoon, Daegu (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 805 days.

(21) Appl. No.: 16/325,799

(22) PCT Filed: Jun. 16, 2017

(86) PCT No.: PCT/KR2017/006356
§ 371 (c)(1),
(2) Date: Feb. 15, 2019

(87) PCT Pub. No.: WO2018/034416
PCT Pub. Date: Feb. 22, 2018

(65) Prior Publication Data

US 2021/0358399 A1 Nov. 18, 2021

(30) Foreign Application Priority Data

Aug. 18, 2016 (KR) ..... 10-2016-0105052

(51) Int. Cl.
*G09G 3/3208* (2016.01)

(52) U.S. Cl.
CPC ... *G09G 3/3208* (2013.01); *G09G 2320/0247* (2013.01); *G09G 2320/046* (2013.01); *G09G 2320/0626* (2013.01); *G09G 2320/10* (2013.01); *G09G 2330/022* (2013.01); *G09G 2330/023* (2013.01); *G09G 2340/12* (2013.01)

(58) Field of Classification Search
CPC ..... G09G 3/3208
See application file for complete search history.

(56) References Cited

U.S. PATENT DOCUMENTS

| | | | |
|---|---|---|---|
| 7,196,700 | B1 | 3/2007 | Aho et al. |
| 7,352,410 | B2 | 4/2008 | Chou |
| 8,385,679 | B2 | 2/2013 | Moon et al. |
| 8,531,383 | B2 | 9/2013 | Toshima et al. |

(Continued)

FOREIGN PATENT DOCUMENTS

| | | | |
|---|---|---|---|
| JP | 5143959 | B1 | 2/2013 |
| KR | 10-2008-0032333 | A | 4/2008 |

(Continued)

OTHER PUBLICATIONS

Indian Search Report dated Aug. 18, 2020.
European Search Report dated Apr. 5, 2019.

*Primary Examiner* — Gustavo Polo
(74) *Attorney, Agent, or Firm* — Cha & Reiter, LLC

(57) ABSTRACT

An electronic device according to various embodiments of the disclosure includes a memory storing an image, a display, and a processor. The processor is configured to display the image on the display, to select at least one pixel, which is displayed on the display at less than specified brightness, from among pixels included in the image, to increase brightness of the selected at least one pixel, and to shift the image displayed on the display. Other embodiments are also possible.

15 Claims, 15 Drawing Sheets

(56) References Cited

U.S. PATENT DOCUMENTS

| | | | |
|---|---|---|---|
| 8,638,339 | B2 | 1/2014 | Choe et al. |
| 9,250,695 | B2 | 2/2016 | Tse |
| 9,640,100 | B2 | 5/2017 | Connell et al. |
| 10,062,363 | B2 | 8/2018 | Kang et al. |
| 10,127,849 | B2 | 11/2018 | Connell et al. |
| 2002/0060650 | A1 | 5/2002 | Wakashiro et al. |
| 2003/0095092 | A1* | 5/2003 | Kume ..... G02F 1/13471 345/87 |
| 2006/0268180 | A1 | 11/2006 | Chou |
| 2007/0176918 | A1 | 8/2007 | Aho et al. |
| 2008/0042927 | A1 | 2/2008 | Jung et al. |
| 2010/0142847 | A1 | 6/2010 | Moon et al. |
| 2010/0265262 | A1 | 10/2010 | Choe. et al. |
| 2010/0265405 | A1 | 10/2010 | Toshima et al. |
| 2011/0304657 | A1 | 12/2011 | Yamamura et al. |
| 2014/0281607 | A1 | 9/2014 | Tse |
| 2016/0049106 | A1 | 2/2016 | Connell et al. |
| 2016/0217770 | A1 | 7/2016 | Kang et al. |
| 2017/0221451 | A1 | 8/2017 | Connell et al. |

FOREIGN PATENT DOCUMENTS

| | | | |
|---|---|---|---|
| KR | 10-2010-0114736 | A | 10/2010 |
| KR | 10-2015-0045748 | A | 4/2015 |
| KR | 10-1517360 | B1 | 5/2015 |
| KR | 10-1612455 | B1 | 4/2016 |

* cited by examiner

ELECTRONIC DEVICE AND IMAGE DISPLAY METHOD OF ELECTRONIC DEVICE

This application is a National Phase Entry of PCT International Application No. PCT/KR2017/006356, which was filed on Jun. 16, 2017 and claims a priority to Korean Patent Application No. 10-2016-0105052, which was filed on Aug. 18, 2016, the contents of which are incorporated herein by reference.

TECHNICAL FIELD

The disclosure relates to a method of displaying an image on a display included in an electronic device.

BACKGROUND ART

With the development of electronic technologies, various types of electronic products are being developed and distributed. In particular, a portable electronic device having a display, such as a smart phone, a tablet personal computer PC, and the like have been increasingly distributed.

Various display panels such as a plasma display panel (PDP), a liquid crystal display (LCD) panel, an organic light emitting diode (OLED) panel, or the like have been be developed and have been applied to the electronic device.

DISCLOSURE

Technical Problem

The OLED display may be turned on/off pixels for each pixel, and may have a feature capable of displaying a black color well while an element is turned off. The red, green, and blue elements included in each pixel of the OLED display have different life cycles, and various arrangements may be used to efficiently adjust the life cycle of an element.

When an image shifts, the blinking may occur depending on the arrangement difference of the elements included in a pixel to be turned on/off at a point in time when the image displayed on a display shifts, and the blinking may remarkably increase depending on the size and pattern of the image.

Various embodiments of the disclosure are to provide an electronic device that prevents the blinking by adjusting the brightness of an image when an image shifts, and an image displaying method of an electronic device.

Technical Solution

According to various embodiments of the disclosure, an electronic device may include a memory storing an image, a display, and a processor. The processor may be configured to display the image on the display, to select at least one pixel, which is displayed on the display at less than specified brightness, from among pixels included in the image, to increase brightness of the selected at least one pixel, and to shift the image displayed on the display.

According to various embodiments of the disclosure, an image displaying method of an electronic device may include displaying an image on a display, selecting at least one pixel, which is displayed on the display at less than specified brightness, from among pixels included in the image, increasing brightness of the selected at least one pixel, and shifting the image displayed on the display.

According to various embodiments of the disclosure, a computer-readable recording medium may records a program that causes an electronic device to perform a method. The method may include displaying an image on a display, selecting at least one pixel, which is displayed on the display at less than specified brightness, from among pixels included in the image, increasing brightness of the selected at least one pixel, and shifting the image displayed on the display.

Advantageous Effects

According to various embodiments of the disclosure, the blinking occurring when an image shifts may be prevented by changing the brightness of a part of pixels included in an image before an image shifts.

MODE FOR INVENTION

Figure 1:
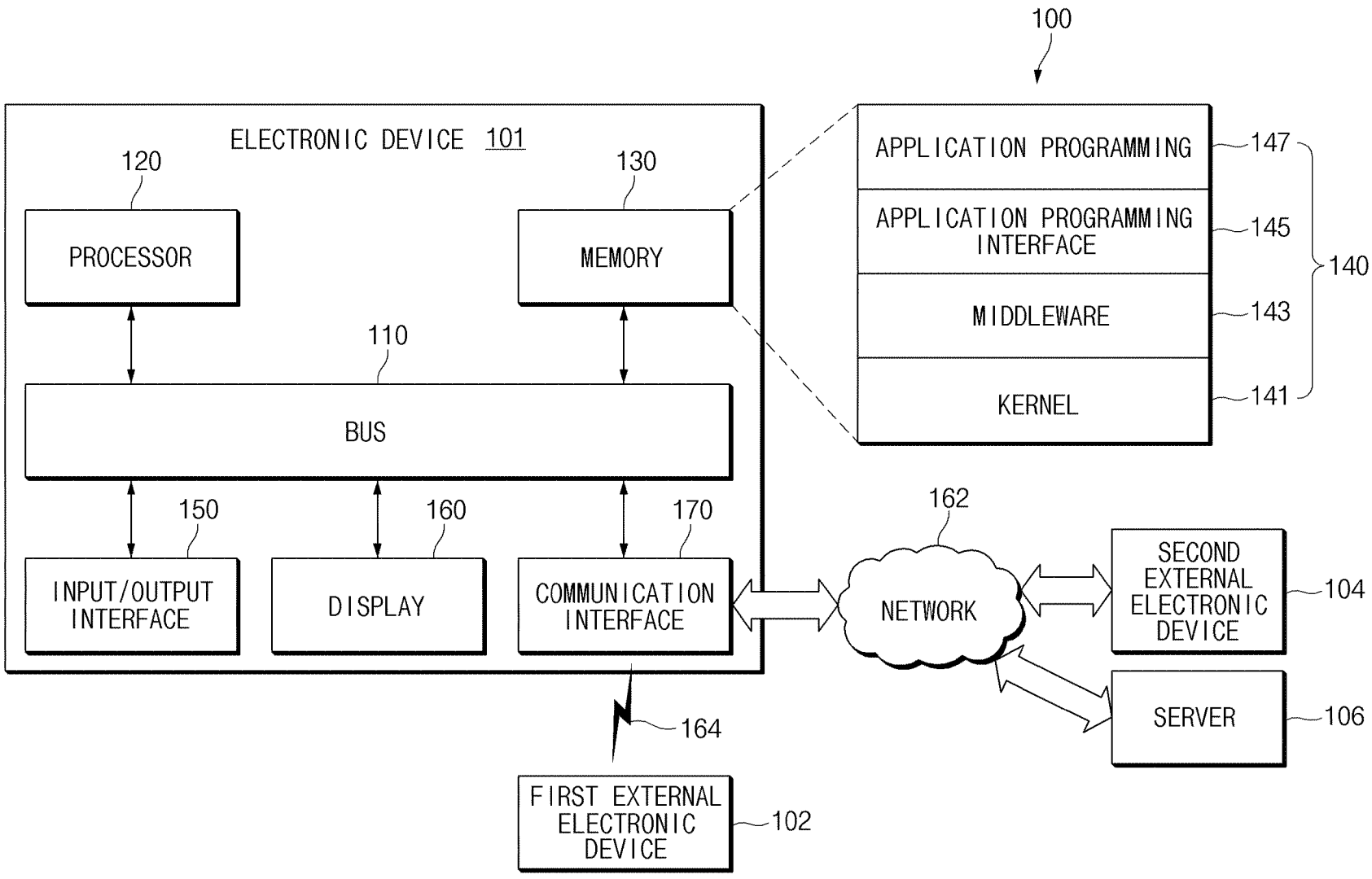
FIG. 1 illustrates an electronic device according to various embodiments.

Hereinafter, various embodiments of the disclosure may be described with reference to accompanying drawings. Accordingly, those of ordinary skill in the art will recognize that modification, equivalent, and/or alternative on the various embodiments described herein can be variously made without departing from the scope and spirit of the disclosure. With regard to description of drawings, similar components may be marked by similar reference numerals.

In the disclosure, the expressions "have", "may have", "include" and "comprise", or "may include" and "may comprise" used herein indicate existence of corresponding features (e.g., components such as numeric values, functions, operations, or parts) but do not exclude presence of additional features.

In the disclosure, the expressions "A or B", "at least one of A or/and B", or "one or more of A or/and B", and the like may include any and all combinations of one or more of the associated listed items. For example, the term "A or B", "at least one of A and B", or "at least one of A or B" may refer to all of the case (1) where at least one A is included, the case (2) where at least one B is included, or the case (3) where both of at least one A and at least one B are included.

The terms, such as "first", "second", and the like used in the disclosure may be used to refer to various components regardless of the order and/or the priority and to distinguish the relevant components from other components, but do not limit the components. For example, "a first user device" and "a second user device" indicate different user devices regardless of the order or priority. For example, without departing the scope of the disclosure, a first component may be referred to as a second component, and similarly, a second component may be referred to as a first component.

It will be understood that when an component (e.g., a first component) is referred to as being "(operatively or communicatively) coupled with/to" or "connected to" another component (e.g., a second component), it may be directly coupled with/to or connected to the other component or an intervening component (e.g., a third component) may be present. In contrast, when an component (e.g., a first component) is referred to as being "directly coupled with/to" or "directly connected to" another component (e.g., a second component), it should be understood that there are no intervening component (e.g., a third component).

According to the situation, the expression "configured to" used in the disclosure may be used as, for example, the expression "suitable for", "having the capacity to", "designed to", "adapted to", "made to", or "capable of". The term "configured to" must not mean only "specifically designed to" in hardware. Instead, the expression "a device configured to" may mean that the device is "capable of" operating together with another device or other parts. For example, a "processor configured to (or set to) perform A, B, and C" may mean a dedicated processor (e.g., an embedded processor) for performing a corresponding operation or a generic-purpose processor (e.g., a central processing unit (CPU) or an application processor) which performs corresponding operations by executing one or more software programs which are stored in a memory device.

Terms used in the disclosure are used to describe specified embodiments and are not intended to limit the scope of the disclosure. The terms of a singular form may include plural forms unless otherwise specified. All the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal unless expressly so defined in various embodiments of the disclosure. In some cases, even if terms are terms which are defined in the disclosure, they may not be interpreted to exclude embodiments of the disclosure.

An electronic device according to various embodiments of the disclosure may include at least one of, for example, smartphones, tablet personal computers (PCs), mobile phones, video telephones, electronic book readers, desktop PCs, laptop PCs, netbook computers, workstations, servers, personal digital assistants (PDAs), portable multimedia players (PMPs), Motion Picture Experts Group (MPEG-1 or MPEG-2) Audio Layer 3 (MP3) players, mobile medical devices, cameras, or wearable devices. According to various embodiments, the wearable device may include at least one of an accessory type (e.g., watches, rings, bracelets, anklets, necklaces, glasses, contact lens, or head-mounted-devices (HMDs), a fabric or garment-integrated type (e.g., an electronic apparel), a body-attached type (e.g., a skin pad or tattoos), or a bio-implantable type (e.g., an implantable circuit).

According to various embodiments, the electronic device may be a home appliance. The home appliances may include at least one of, for example, televisions (TVs), digital versatile disc (DVD) players, audios, refrigerators, air conditioners, cleaners, ovens, microwave ovens, washing machines, air cleaners, set-top boxes, home automation control panels, security control panels, TV boxes (e.g., Samsung HomeSync™, Apple TV™, or Google TV™), game consoles (e.g., Xbox™ or PlayStation™), electronic dictionaries, electronic keys, camcorders, electronic picture frames, and the like.

According to another embodiment, an electronic device may include at least one of various medical devices (e.g., various portable medical measurement devices (e.g., a blood glucose monitoring device, a heartbeat measuring device, a blood pressure measuring device, a body temperature measuring device, and the like), a magnetic resonance angiography (MRA), a magnetic resonance imaging (MRI), a computed tomography (CT), scanners, and ultrasonic devices), navigation devices, Global Navigation Satellite System (GNSS), event data recorders (EDRs), flight data recorders (FDRs), vehicle infotainment devices, electronic equipment for vessels (e.g., navigation systems and gyrocompasses), avionics, security devices, head units for vehicles, industrial or home robots, automated teller machines (ATMs), points of sales (POSs) of stores, or internet of things (e.g., light bulbs, various sensors, electric or gas meters, sprinkler devices, fire alarms, thermostats, street lamps, toasters, exercise equipment, hot water tanks, heaters, boilers, and the like).

According to an embodiment, the electronic device may include at least one of parts of furniture or buildings/structures, electronic boards, electronic signature receiving devices, projectors, or various measuring instruments (e.g., water meters, electricity meters, gas meters, or wave meters, and the like). According to various embodiments, the electronic device may be one of the above-described devices or a combination thereof. An electronic device according to an embodiment may be a flexible electronic device. Furthermore, an electronic device according to an embodiment of the disclosure may not be limited to the above-described electronic devices and may include other electronic devices and new electronic devices according to the development of technologies.

Hereinafter, electronic devices according to various embodiments will be described with reference to the accompanying drawings. In the disclosure, the term "user" may refer to a person who uses an electronic device or may refer to a device (e.g., an artificial intelligence electronic device) that uses the electronic device.

FIG. 1 illustrates an electronic device, according to various embodiments.

Referring to FIG. 1, according to various embodiments, an electronic device 101, 102, or 104, or a server 106 may be connected each other over a network 162 or a short range communication 164. The electronic device 101 may include a bus 110, a processor 120, a memory 130, an input/output interface 150, a display 160, and a communication interface 170. According to an embodiment, the electronic device 101 may not include at least one of the above-described components or may further include other component(s).

For example, the bus 110 may interconnect the above-described components 110 to 170 and may include a circuit for conveying communications (e.g., a control message and/or data) among the above-described components.

The processor 120 may include one or more of a central processing unit (CPU), an application processor (AP), or a communication processor (CP). For example, the processor 120 may perform an arithmetic operation or data processing associated with control and/or communication of at least other components of the electronic device 101.

The memory 130 may include a volatile and/or nonvolatile memory. For example, the memory 130 may store commands or data associated with at least one other component(s) of the electronic device 101. According to an embodiment, the memory 130 may store software and/or a program 140. The program 140 may include, for example, a kernel 141, a middleware 143, an application programming interface (API) 145, and/or an application program (or "an application") 147. At least a part of the kernel 141, the middleware 143, or the API 145 may be referred to as an "operating system (OS)".

For example, the kernel 141 may control or manage system resources (e.g., the bus 110, the processor 120, the memory 130, and the like) that are used to execute operations or functions of other programs (e.g., the middleware 143, the API 145, and the application program 147). Furthermore, the kernel 141 may provide an interface that allows the middleware 143, the API 145, or the application program 147 to access discrete components of the electronic device 101 so as to control or manage system resources.

The middleware 143 may perform, for example, a mediation role such that the API 145 or the application program 147 communicates with the kernel 141 to exchange data. Furthermore, the middleware 143 may process task requests received from the application program 147 according to a priority. For example, the middleware 143 may assign the priority, which makes it possible to use a system resource (e.g., the bus 110, the processor 120, the memory 130, or the like) of the electronic device 101, to at least one of the application program 147. For example, the middleware 143 may process the one or more task requests according to the priority assigned to the at least one, which makes it possible to perform scheduling or load balancing on the one or more task requests.

The API 145 may be, for example, an interface through which the application program 147 controls a function provided by the kernel 141 or the middleware 143, and may include, for example, at least one interface or function (e.g., an instruction) for a file control, a window control, image processing, a character control, or the like.

The input/output interface 150 may play a role, for example, of an interface which transmits a command or data input from a user or another external device, to other component(s) of the electronic device 101. Furthermore, the input/output interface 150 may output a command or data, received from other component(s) of the electronic device 101, to a user or another external device.

The display 160 may include, for example, a liquid crystal display (LCD), a light-emitting diode (LED) display, an organic LED (OLED) display, a microelectromechanical systems (MEMS) display, or an electronic paper display. The display 160 may display, for example, various contents (e.g., a text, an image, a video, an icon, a symbol, and the like) to a user. The display 160 may include a touch screen and may receive, for example, a touch, gesture, proximity, or hovering input using an electronic pen or a part of a user's body.

For example, the communication interface 170 may establish communication between the electronic device 101 and an external device (e.g., the first external electronic device 102, the second external electronic device 104, or the server 106). For example, the communication interface 170 may be connected to the network 162 over wireless communication or wired communication to communicate with the external device (e.g., the second external electronic device 104 or the server 106).

The wireless communication may include cellular communication using at least one of, for example, long-term evolution (LTE), LTE Advanced (LTE-A), Code Division Multiple Access (CDMA), Wideband CDMA (WCDMA), Universal Mobile Telecommunications System (UNITS), Wireless Broadband (WiBro), Global System for Mobile Communications (GSM), or the like, as cellular communication protocol. According to an embodiment, the wireless communication may include, for example, at least one of wireless fidelity (Wi-Fi), Bluetooth, Bluetooth low energy (BLE), Zigbee, near field communication (NFC), magnetic secure transmission (MST), a radio frequency (RF), a body area network (BAN), a global navigation satellite system (GNSS), or the like.

The MST may generate a pulse in response to transmission data using an electromagnetic signal, and the pulse may generate a magnetic field signal. The electronic device 101 may transfer the magnetic field signal to point of sale (POS), and the POS may detect the magnetic field signal using a MST reader. The POS may recover the data by converting the detected magnetic field signal to an electrical signal.

The GNSS may include at least one of, for example, a global positioning system (GPS), a global navigation satellite system (Glonass), a Beidou navigation satellite system (hereinafter referred to as "Beidou"), or an European global satellite-based navigation system (hereinafter referred to as "Galileo") based on an available region, a bandwidth, or the like. Hereinafter, in the disclosure, "GPS" and "GNSS" may be interchangeably used. The wired communication may include at least one of, for example, a universal serial bus (USB), a high definition multimedia interface (HDMI), a recommended standard-232 (RS-232), a plain old telephone service (POTS), or the like. The network 162 may include at least one of telecommunications networks, for example, a computer network (e.g., LAN or WAN), an Internet, or a telephone network.

Each of the first and second external electronic devices 102 and 104 may be a device of which the type is different from or the same as that of the electronic device 101. According to an embodiment, the server 106 may include a group of one or more servers. According to various embodiments, all or a portion of operations that the electronic device 101 will perform may be executed by another or plural electronic devices (e.g., the first external electronic device 102, the second external electronic device 104 or the server 106). According to an embodiment, in the case where the electronic device 101 executes any function or service automatically or in response to a request, the electronic device 101 may not perform the function or the service internally, but, alternatively additionally, it may request at least a portion of a function associated with the electronic device 101 from another device (e.g., the first external electronic device 102, the second external electronic device 104 or the server 106). The other electronic device (e.g., the first external electronic device 102, the second external electronic device 104 or the server 106) may execute the requested function or additional function and may transmit the execution result to the electronic device 101. The electronic device 101 may provide the requested function or service using the received result or may additionally process the received result to provide the requested function or service. To this end, for example, cloud computing, distributed computing, or client-server computing may be used.

Figure 2:
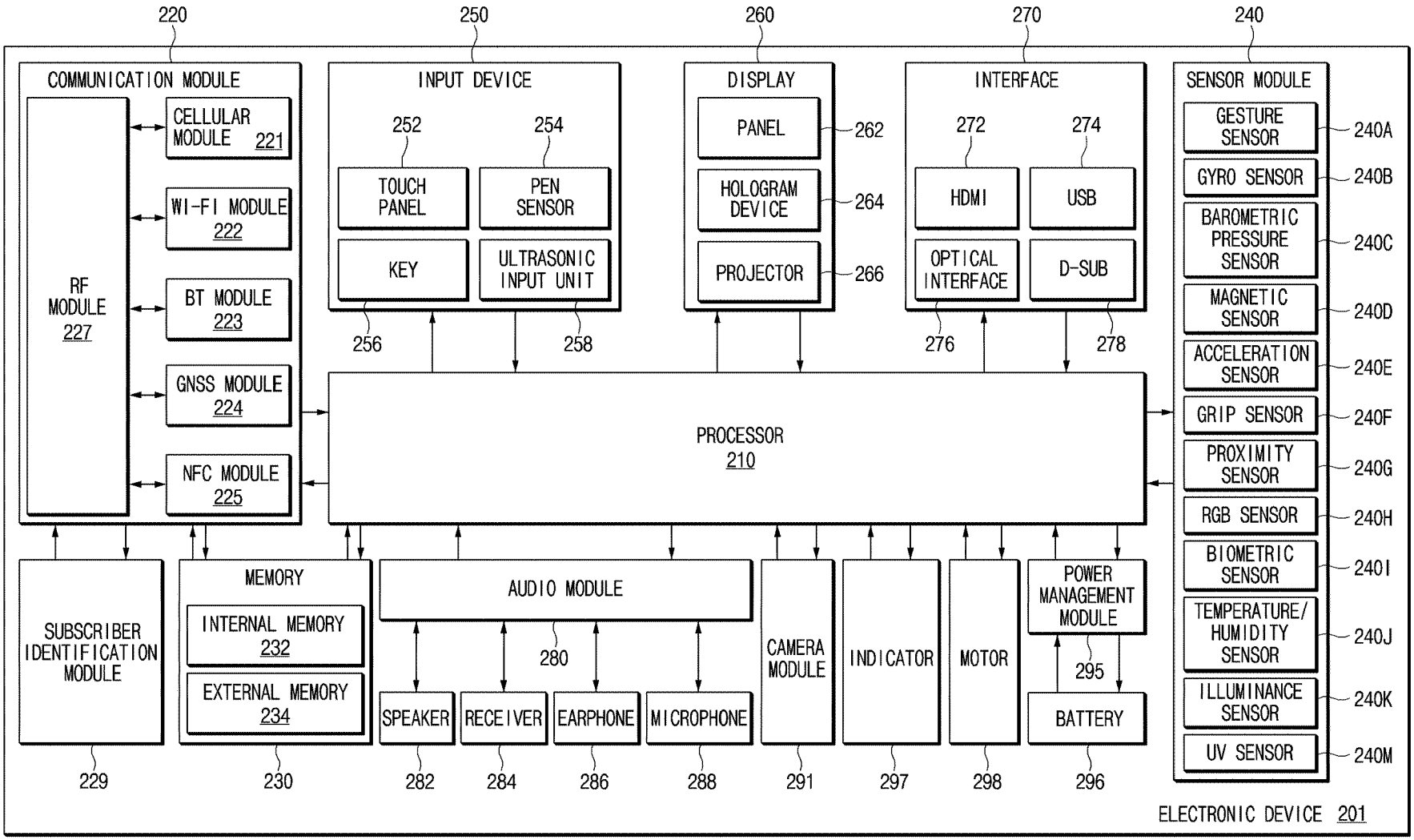
FIG. 2 illustrates a block diagram of the electronic device, according to various embodiments.

FIG. 2 illustrates a block diagram of an electronic device, according to various embodiments.

Referring to FIG. 2, an electronic device 201 may include, for example, all or a part of the electronic device 101 illustrated in FIG. 1. The electronic device 201 may include one or more processors (e.g., an application processor (AP)) 210, a communication module 220, a subscriber identification module 229, a memory 230, a sensor module 240, an input device 250, a display 260, an interface 270, an audio module 280, a camera module 291, a power management module 295, a battery 296, an indicator 297, and a motor 298.

The processor 210 may drive, for example, an operating system (OS) or an application to control a plurality of hardware or software components connected to the processor 210 and may process and compute a variety of data. For example, the processor 210 may be implemented with a System on Chip (SoC). According to an embodiment, the processor 210 may further include a graphic processing unit (GPU) and/or an image signal processor. The processor 210 may include at least a part (e.g., a cellular module 221) of components illustrated in FIG. 2. The processor 210 may load a command or data, which is received from at least one of other components (e.g., a nonvolatile memory), into a volatile memory and process the loaded command or data. The processor 210 may store a variety of data in the nonvolatile memory.

The communication module 220 may be configured the same as or similar to the communication interface 170 of FIG. 1. The communication module 220 may include the cellular module 221, a Wi-Fi module 222, a Bluetooth (BT) module 223, a GNSS module 224 (e.g., a GPS module, a Glonass module, a Beidou module, or a Galileo module), a near field communication (NFC) module 225, and a radio frequency (RF) module 227.

The cellular module 221 may provide, for example, voice communication, video communication, a character service, an Internet service, or the like over a communication network. According to an embodiment, the cellular module 221 may perform discrimination and authentication of the electronic device 201 within a communication network by using the subscriber identification module (e.g., a SIM card) 229. According to an embodiment, the cellular module 221 may perform at least a portion of functions that the processor 210 provides. According to an embodiment, the cellular module 221 may include a communication processor (CP).

Each of the Wi-Fi module 222, the BT module 223, the GNSS module 224, or the NFC module 225 may include a processor for processing data exchanged through a corresponding module, for example. According to an embodiment, at least a part (e.g., two or more) of the cellular module 221, the Wi-Fi module 222, the BT module 223, the GNSS module 224, or the NFC module 225 may be included within one Integrated Circuit (IC) or an IC package.

For example, the RF module 227 may transmit and receive a communication signal (e.g., an RF signal). For example, the RF module 227 may include a transceiver, a power amplifier module (PAM), a frequency filter, a low noise amplifier (LNA), an antenna, or the like. According to another embodiment, at least one of the cellular module 221, the Wi-Fi module 222, the BT module 223, the GNSS module 224, or the NFC module 225 may transmit and receive an RF signal through a separate RF module.

The subscriber identification module 229 may include, for example, a card and/or embedded SIM that includes a subscriber identification module and may include unique identify information (e.g., integrated circuit card identifier (ICCID)) or subscriber information (e.g., integrated mobile subscriber identity (IMSI)).

The memory 230 (e.g., the memory 130) may include an internal memory 232 or an external memory 234. For example, the internal memory 232 may include at least one of a volatile memory (e.g., a dynamic random access memory (DRAM), a static RAM (SRAM), a synchronous DRAM (SDRAM), or the like), a nonvolatile memory (e.g., a one-time programmable read only memory (OTPROM), a programmable ROM (PROM), an erasable and programmable ROM (EPROM), an electrically erasable and programmable ROM (EEPROM), a mask ROM, a flash ROM, a flash memory (e.g., a NAND flash memory or a NOR flash memory), or the like), a hard drive, or a solid state drive (SSD).

The external memory 234 may further include a flash drive such as compact flash (CF), secure digital (SD), micro secure digital (Micro-SD), mini secure digital (Mini-SD), extreme digital (xD), a multimedia card (MMC), a memory stick, or the like. The external memory 234 may be operatively and/or physically connected to the electronic device 201 through various interfaces.

A security module 236 may be a module that includes a storage space of which a security level is higher than that of the memory 230 and may be a circuit that guarantees safe data storage and a protected execution environment. The security module 236 may be implemented with a separate circuit and may include a separate processor. For example, the security module 236 may be in a smart chip or a secure digital (SD) card, which is removable, or may include an embedded secure element (eSE) embedded in a fixed chip of the electronic device 201. Furthermore, the security module 236 may operate based on an operating system (OS) that is different from the OS of the electronic device 201. For example, the security module 236 may operate based on java card open platform (JCOP) OS.

The sensor module 240 may measure, for example, a physical quantity or may detect an operation state of the electronic device 201. The sensor module 240 may convert the measured or detected information to an electric signal. For example, the sensor module 240 may include at least one of a gesture sensor 240A, a gyro sensor 240B, a barometric pressure sensor 240C, a magnetic sensor 240D, an acceleration sensor 240E, a grip sensor 240F, the proximity sensor 240G, a color sensor 240H (e.g., red, green, blue (RGB) sensor), a biometric sensor 240I, a temperature/humidity sensor 240J, an illuminance sensor 240K, or an UV sensor 240M. Although not illustrated, additionally or alternatively, the sensor module 240 may further include, for example, an E-nose sensor, an electromyography (EMG) sensor, an electroencephalogram (EEG) sensor, an electrocardiogram (ECG) sensor, an infrared (IR) sensor, an iris sensor, and/or a fingerprint sensor. The sensor module 240 may further include a control circuit for controlling at least one or more sensors included therein. According to an embodiment, the electronic device 201 may further include a processor that is a part of the processor 210 or independent of the processor 210 and is configured to control the sensor module 240. The processor may control the sensor module 240 while the processor 210 remains at a sleep state.

The input device 250 may include, for example, a touch panel 252, a (digital) pen sensor 254, a key 256, or an ultrasonic input unit 258. For example, the touch panel 252 may use at least one of capacitive, resistive, infrared and ultrasonic detecting methods. Also, the touch panel 252 may further include a control circuit. The touch panel 252 may further include a tactile layer to provide a tactile reaction to a user.

The (digital) pen sensor 254 may be, for example, a part of a touch panel or may include an additional sheet for recognition. The key 256 may include, for example, a physical button, an optical key, a keypad, or the like. The ultrasonic input device 258 may detect (or sense) an ultrasonic signal, which is generated from an input device, through a microphone (e.g., a microphone 288) and may check data corresponding to the detected ultrasonic signal.

The display 260 (e.g., the display 160) may include a panel 262, a hologram device 264, or a projector 266. The panel 262 may be the same as or similar to the display 160 illustrated in FIG. 1. The panel 262 may be implemented, for example, to be flexible, transparent or wearable. The panel 262 and the touch panel 252 may be integrated into a single module. The hologram device 264 may display a stereoscopic image in a space using a light interference phenomenon. The projector 266 may project light onto a screen so as to display an image. For example, the screen may be arranged in the inside or the outside of the electronic device 201. According to an embodiment, the panel 262 may include a pressure sensor (or force sensor) that measures the intensity of touch pressure by a user. The pressure sensor may be implemented integrally with the touch panel 252, or may be implemented as at least one sensor separately from the touch panel 252. According to an embodiment, the display 260 may further include a control circuit for controlling the panel 262, the hologram device 264, or the projector 266.

The interface 270 may include, for example, a high-definition multimedia interface (HDMI) 272, a universal serial bus (USB) 274, an optical interface 276, or a D-sub-miniature (D-sub) 278. The interface 270 may be included, for example, in the communication interface 170 illustrated in FIG. 1. Additionally or alternatively, the interface 270 may include, for example, a mobile high definition link (MHL) interface, a SD card/multi-media card (MMC) interface, or an infrared data association (IrDA) standard interface.

The audio module 280 may convert a sound and an electric signal in dual directions. At least a component of the audio module 280 may be included, for example, in the input/output interface 150 illustrated in FIG. 1. The audio module 280 may process, for example, sound information that is input or output through a speaker 282, a receiver 284, an earphone 286, or the microphone 288.

For example, the camera module 291 may shoot a still image or a video. According to an embodiment, the camera module 291 may include at least one or more image sensors (e.g., a front sensor or a rear sensor), a lens, an image signal processor (ISP), or a flash (e.g., an LED or a xenon lamp).

The power management module 295 may manage, for example, power of the electronic device 201. According to an embodiment, a power management integrated circuit (PMIC), a charger IC, or a battery or fuel gauge may be included in the power management module 295. The PMIC may have a wired charging method and/or a wireless charging method. The wireless charging method may include, for example, a magnetic resonance method, a magnetic induction method or an electromagnetic method and may further include an additional circuit, for example, a coil loop, a resonant circuit, or a rectifier, and the like. The battery gauge may measure, for example, a remaining capacity of the battery 296 and a voltage, current or temperature thereof while the battery is charged. The battery 296 may include, for example, a rechargeable battery and/or a solar battery.

The indicator 297 may display a specific state of the electronic device 201 or a part thereof (e.g., the processor 210), such as a booting state, a message state, a charging state, and the like. The motor 298 may convert an electrical signal into a mechanical vibration and may generate the following effects: vibration, haptic, and the like. Although not illustrated, a processing device (e.g., a GPU) for supporting a mobile TV may be included in the electronic device 201. The processing device for supporting the mobile TV may process media data according to the standards of digital multimedia broadcasting (DMB), digital video broadcasting (DVB), MediaFlo™, or the like.

Each of the above-mentioned components of the electronic device according to various embodiments of the disclosure may be configured with one or more parts, and the names of the components may be changed according to the type of the electronic device. In various embodiments, the electronic device may include at least one of the above-mentioned components, and some components may be omitted or other additional components may be added. Furthermore, some of the components of the electronic device according to various embodiments may be combined with each other so as to form one entity, so that the functions of the components may be performed in the same manner as before the combination.

Figure 3:
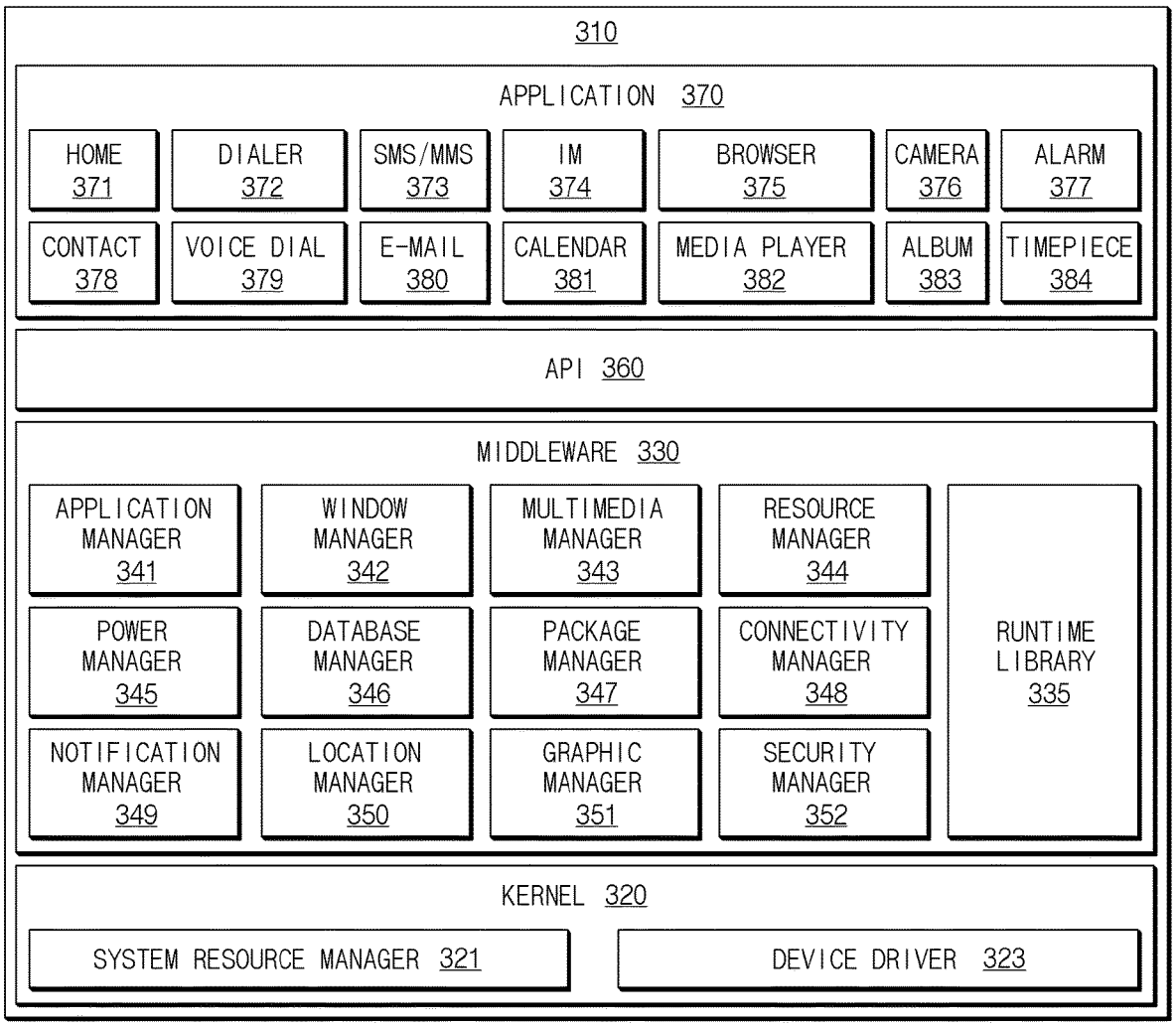
FIG. 3 illustrates a block diagram of a program module according to various embodiments.

FIG. 3 illustrates a block diagram of a program module, according to various embodiments.

According to an embodiment, a program module 310 (e.g., the program 140) may include an operating system (OS) to control resources associated with an electronic device (e.g., the electronic device 101), and/or diverse applications (e.g., the application program 147) driven on the OS. The OS may be, for example, Android™, iOS™, Windows™, Symbian™, Tizen™, or Bada™.

The program module 310 may include a kernel 320, a middleware 330, an application programming interface (API) 360, and/or an application 370. At least a portion of the program module 310 may be preloaded on an electronic device or may be downloadable from an external electronic device (e.g., the electronic device 102 or 104, the server 106, or the like).

The kernel 320 (e.g., the kernel 141) may include, for example, a system resource manager 321 or a device driver 323. The system resource manager 321 may perform control, allocation, or retrieval of system resources. According to an embodiment, the system resource manager 321 may include a process managing unit, a memory managing unit, or a file system managing unit. The device driver 323 may include, for example, a display driver, a camera driver, a Bluetooth driver, a shared memory driver, a USB driver, a keypad driver, a Wi-Fi driver, an audio driver, or an inter-process communication (IPC) driver.

The middleware 330 may provide, for example, a function that the application 370 needs in common, or may provide diverse functions to the application 370 through the API 360 to allow the application 370 to efficiently use limited system resources of the electronic device. According to an embodiment, the middleware 330 (e.g., the middleware 143) may include at least one of a runtime library 335, an application manager 341, a window manager 342, a multimedia manager 343, a resource manager 344, a power manager 345, a database manager 346, a package manager 347, a connectivity manager 348, a notification manager 349, a location manager 350, a graphic manager 351, a security manager 352, or a payment manager 354.

The runtime library 335 may include, for example, a library module that is used by a compiler to add a new function through a programming language while the application 370 is being executed. The runtime library 335 may perform input/output management, memory management, or capacities about arithmetic functions.

The application manager 341 may manage, for example, a life cycle of at least one application of the application 370. The window manager 342 may manage a graphic user interface (GUI) resource that is used in a screen. The multimedia manager 343 may identify a format necessary for playing diverse media files, and may perform encoding or decoding of media files by using a codec suitable for the format. The resource manager 344 may manage resources such as a storage space, memory, or source code of at least one application of the application 370.

The power manager 345 may operate, for example, with a basic input/output system (BIOS) to manage a battery or power, and may provide power information for an operation of an electronic device. The database manager 346 may generate, search for, or modify database that is to be used in at least one application of the application 370. The package manager 347 may install or update an application that is distributed in the form of package file.

The connectivity manager 348 may manage, for example, wireless connection such as Wi-Fi or Bluetooth. The notification manager 349 may display or notify an event such as arrival message, appointment, or proximity notification in a mode that does not disturb a user. The location manager 350 may manage location information about an electronic device. The graphic manager 351 may manage a graphic effect that is provided to a user, or manage a user interface relevant thereto. The security manager 352 may provide a general security function necessary for system security, user authentication, or the like. According to an embodiment, in the case where an electronic device (e.g., the electronic device 101) includes a telephony function, the middleware 330 may further include a telephony manager for managing a voice or video call function of the electronic device.

The middleware 330 may include a middleware module that combines diverse functions of the above-described components. The middleware 330 may provide a module specialized to each OS kind to provide differentiated functions. Additionally, the middleware 330 may dynamically remove a part of the preexisting components or may add new components thereto.

The API 360 (e.g., the API 145) may be, for example, a set of programming functions and may be provided with a configuration that is variable depending on an OS. For example, in the case where an OS is Android™ or iOS™, it may provide one API set per platform. In the case where an OS is Tizen™, it may provide two or more API sets per platform.

The application 370 (e.g., the application program 147) may include, for example, one or more applications capable of providing functions for a home 371, a dialer 372, an SMS/MMS 373, an instant message (IM) 374, a browser 375, a camera 376, an alarm 377, a contact 378, a voice dial 379, an e-mail 380, a calendar 381, a media player 382, an album 383, a timepiece 384, or for offering health care (e.g., measuring an exercise quantity, blood sugar, or the like) or environment information (e.g., information of barometric pressure, humidity, temperature, or the like).

According to an embodiment, the application 370 may include an application (hereinafter referred to as "information exchanging application" for descriptive convenience) to support information exchange between an electronic device (e.g., the electronic device 101) and an external electronic device (e.g., the first external electronic device 102 or the second external electronic device 104). The information exchanging application may include, for example, a notification relay application for transmitting specific information to an external electronic device, or a device management application for managing the external electronic device.

For example, the notification relay application may include a function of transmitting notification information, which arise from other applications (e.g., applications for SMS/MMS, e-mail, health care, or environmental information), to an external electronic device (e.g., the first external electronic device 102 or the second external electronic device 104). Additionally, the notification relay application may receive, for example, notification information from an external electronic device and provide the notification information to a user.

The device management application may manage (e.g., install, delete, or update), for example, at least one function (e.g., turn-on/turn-off of an external electronic device itself (or a part) or adjustment of brightness (or resolution) of a display) of the external electronic device (e.g., the first external electronic device 102 or the second external electronic device 104) which communicates with the electronic device, an application running in the external electronic device, or a service (e.g., a call service, a message service, or the like) provided from the external electronic device.

According to an embodiment, the application 370 may include an application (e.g., a health care application of a mobile medical device) that is assigned in accordance with an attribute of an external electronic device (e.g., the first external electronic device 102 or the second external electronic device 104). According to an embodiment, the application 370 may include an application that is received from an external electronic device (e.g., the server 106, the first external electronic device 102, or the second external electronic device 104). According to an embodiment, the application 370 may include a preloaded application or a third party application that is downloadable from a server. The names of components of the program module 310 according to the embodiment may be modifiable depending on kinds of operating systems.

According to various embodiments, at least a portion of the program module 310 may be implemented by software, firmware, hardware, or a combination of two or more thereof. At least a portion of the program module 310 may be implemented (e.g., executed), for example, by the processor (e.g., the processor 210). At least a portion of the program module 310 may include, for example, modules, programs, routines, sets of instructions, processes, or the like for performing one or more functions.

Figure 4:
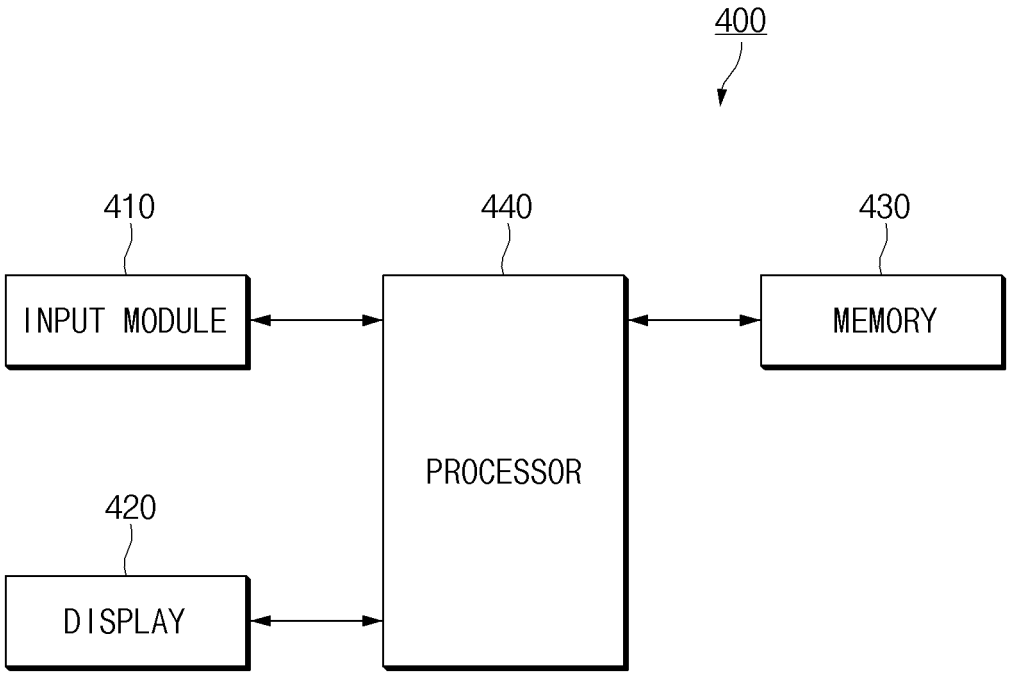
FIG. 4 is a block diagram illustrating a configuration of an electronic device, according to various embodiments of the disclosure.

FIG. 4 is a block diagram illustrating a configuration of an electronic device, according to various embodiments of the disclosure.

Referring to FIG. 4, an electronic device 400 may include an input module 410, a display 420, a memory 430, and a processor 440. The electronic device 400 may include a normal mode and a low power mode. For example, the normal mode may indicate a mode, in which all the components 410 to 440 included in the electronic device 400 are activated or operate without power reduction, such as an awake mode. For example, the low power mode may indicate a mode in which at least part of components 410 to 440 included in the electronic device 400 operate in a state for the power reduction, such as the sleep mode. For example, the electronic device 400 may deactivate a part (e.g., a main processor) of the processor 440 in the low power mode. Alternatively, the electronic device 400 may drive the input module 410 such that the input module 410 senses whether the user input is received, without determining a location of a user input, or may drive the display 420 in the low power mode (e.g., an AMOLED low power mode (ALPM)).

According to an embodiment, the electronic device 400 may display an image on the display 420 in the low power mode. For example, the image (or image data) may include at least one object of a figure, a character, an icon, a symbol, and a text. According to an embodiment, the electronic device 400 may shift the image displayed on the display 420 in the low power mode. When shifting the image, the electronic device 400 may continuously change the location of the image for animation effects during a specified time. When the location of the image changes continuously, blinking may occur in the image. The blinking may be caused by the difference in the arrangement of the sub pixels included in each of the pixels when the pixels are turned on/off depending on the shift of the image. For example, the blinking may occur when the second type pixel turned off is turned on or the first type pixel turned on is turned off, after a specific pixel in an image is shifted from a pixel of the first type to a pixel of the second type. According to an embodiment, when shifting the image to prevent the image from blinking, the electronic device 400 may adjust the brightness of the pixels displayed on the display at less than the specified brightness.

According to an embodiment, the input module 410 may receive the user input. For example, the input module 410 may receive the user input for activating the always on display (AOD) function. For example, the AOD may indicate a function to display an image (or image data) in at least a partial area of the display 420 even when the electronic device 400 operates in the low power mode. For another example, the input module 410 may receive the user input for selecting an image (or an AOD image) to be displayed in the display 420 in a state where the AOD function is activated. For example, a user may select an image, which the user photographs or which is received from an external electronic device, for the AOD function as well as an image stored in the memory 430 in advance. For still another example, the input module 410 may receive memo data from a user in a state where the electronic device 400 (or the display 420) operates in a low power mode.

According to an embodiment, the input module 410 may include a touch sensor panel which senses a touch manipulation of a user or a pen sensor panel which senses a pen manipulation of the user. According to an embodiment, the touch sensor panel may include a pressure sensor for sensing pressure associated with a user touch. The pressure sensor may be integrally implemented with the touch sensor panel or the display 420 or may be implemented with one or more sensors independently of the touch sensor panel.

According to an embodiment, the display 420 may display an image. According to an embodiment, the display 420 may display the image when the electronic device 400 operates in the low power mode (e.g., a sleep mode) as well as when the electronic device 400 operates in the normal mode (e.g., an awake mode). According to an embodiment, the display 420 may shift the displayed image. For example, the display 420 may periodically shift the AOD image within a specified shift range. According to an embodiment, when shifting the image, the display 420 may continuously change the location of the image during a specified time. For example, the display 420 may create animation effects by continuously changing the location of the image in the specified direction during a specified time within one shift cycle by a specified interval.

According to an embodiment, the display 420 may be a light emitting diode (LED) (e.g., an organic light emitting diode (OLED)) display. According to an embodiment, for example, the input module 410 and the display 420 may be implemented with a touch screen, in which the touch sensor panel may be disposed on the display panel and which is capable of displaying and sensing the touch input at the same time.

According to an embodiment, the memory 430 may store at least one image. According to an embodiment, the memory 430 may map information about the display location, shift range, shift interval, or shift direction of the image set for each image to store the mapped image.

According to an embodiment, the processor 440 may control overall operations of the electronic device 400. According to various embodiments, the processor 440 may display an image on the display 420 by controlling the input module 410, the display 420, and the memory 430, respectively. According to an embodiment, the processor 440 (e.g., an application processor) may be implemented with a system on chip (SoC) that includes at least one of a processor (e.g., a central processing unit (CPU), a graphic processing unit (GPU), or the like), a memory, and the like.

According to an embodiment, the processor 440 may display an image on the display 420 in the low power mode. For example, the processor 440 may display the AOD image on the display 420 in the low power mode. For another example, the processor 440 may display a memo input from a user in a low power mode or may display a notification message (or notification image) on the display 420 when a notification event occurs. For another example, the processor 440 may display a user interface (UI) image provided by an application (e.g., a music application) running in the background in the low power mode.

According to an embodiment, the processor 440 may shift the image displayed on the display 420 in the low power mode. For example, the shift of an image may include not only the location change of the image but also the shape change or the size change of the image.

Figure 5:
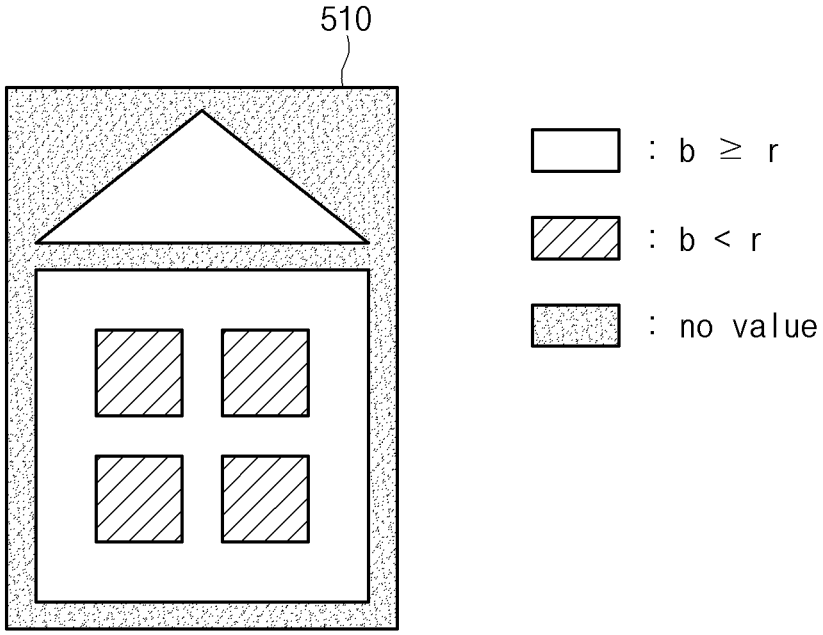
FIG. 5 is a view illustrating an image, according to various embodiments of the disclosure.

FIG. 5 is a view illustrating an image, according to various embodiments of the disclosure.

According to an embodiment, the processor 440 may identify pixels, which are displayed on the display 420 at less than the specified brightness, from among the pixels included in an image. The image may include an effective pixel including a pixel value and a non-effective pixel not including a pixel value. When an image is displayed on the display 420, the effective pixel may be represented by the color and brightness corresponding to a pixel value, and the non-effective pixel may be displayed in the background color or black. According to an embodiment, the processor 440 may identify (or determine) the brightness (or brightness values) of the pixels included in the image. According to an embodiment, the processor 440 may identify the pixel values of the effective pixels included in the image and may identify the brightness values of the effective pixels based on the pixel values. For example, the processor 440 may identify a pixel value of each of a plurality of sub pixels included in each pixel, and may determine the maximum value among pixel values of the plurality of sub pixels as brightness value 'b'. According to an embodiment, the processor 440 may determine the brightness value of each of the non-effective pixels included in the image as '0'.

According to an embodiment, the processor 440 may identify pixels displayed on the display 420 at less than the specified brightness by comparing the brightness value of each of the pixels included in the image with a reference brightness value. For example, the reference brightness value may be determined by the feature (e.g., luminance) of the display panel as a brightness value, the pixel of which is recognized as black by a user or the pixel of which is capable of being displayed in black, when the pixel is displayed. For example, the processor 440 may identify a pixel having a brightness value less than the reference brightness value (e.g., black pixel) among effective pixels and a non-effective pixel as a pixel displayed on a display at brightness lower than the specified brightness. For example, referring to FIG. 5, an image 510 may include pixels, brightness value 'b' of each of which is not less than reference brightness value 'r', from among effective pixels, pixels, brightness value 'b' of each of which is less than reference brightness value 'r', from among the effective pixels, and non-effective pixels, each of which does not include a pixel value (or brightness value 'b' of each of which is '0').

Figure 6:
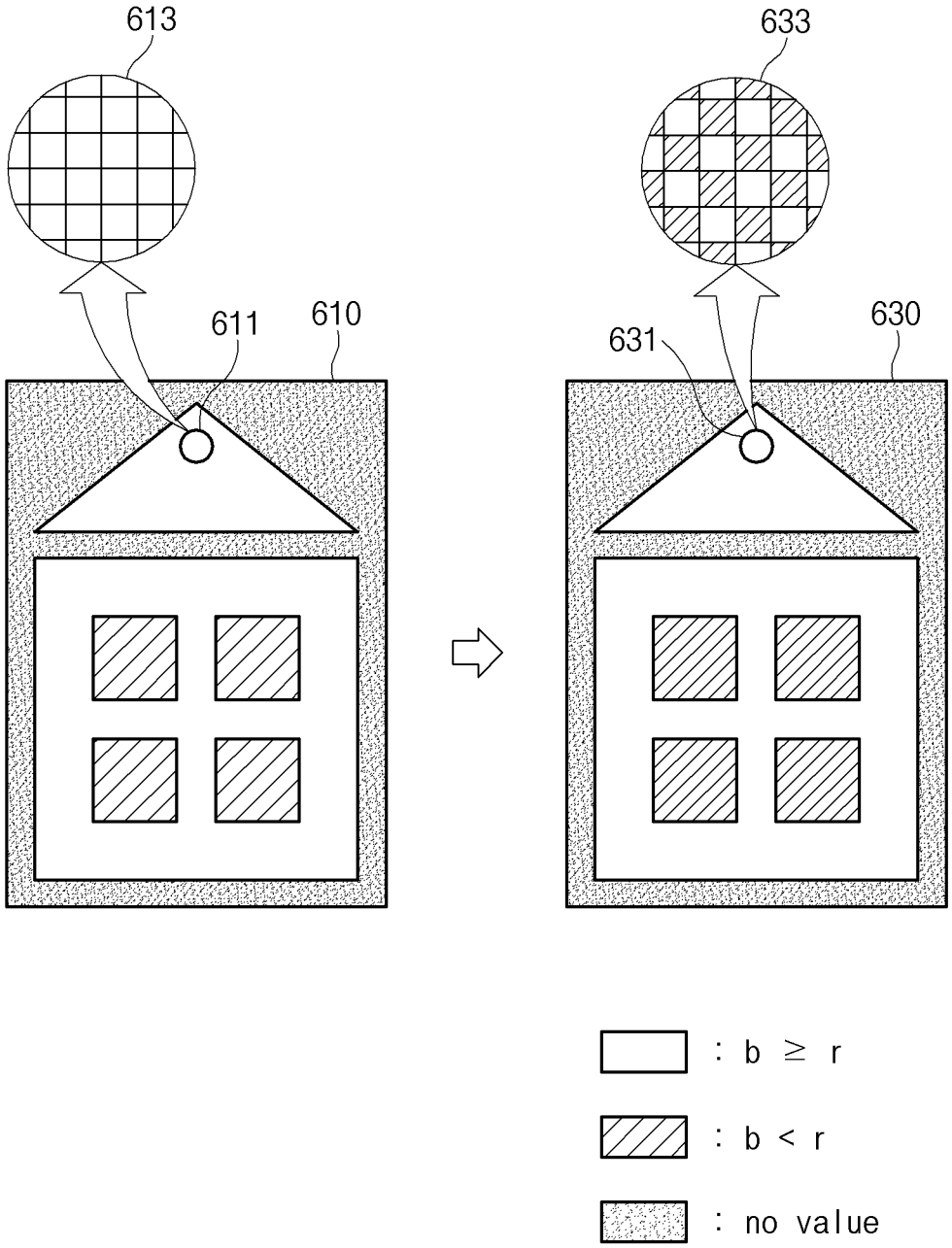
FIG. 6 is a view illustrating an image modified before an image is displayed on a display.

FIG. 6 is a view illustrating an image modified before an image is displayed on a display.

According to an embodiment, the processor 440 may modify at least part of an image to be displayed before displaying an image 610. When the stress is accumulated in the OLED panel, burn-in phenomena (or afterimage) may occur due to deterioration of the specific device. For the purpose of reducing stress, the processor 440 may modify some of the effective pixels included in the image so as not to be displayed on the display 420. For example, the processor 440 may divide the effective pixels included in the image into a plurality of groups (e.g., the first group and the second group) and may remove the pixel value of a part (e.g., first group) of the plurality of groups or may modify the pixel value to less than specified brightness (e.g., 0, 0, 0).

The first image 610 illustrated in FIG. 6 represents an original image before modification; a second image 630 represents the modified image. Each of the first image 610 and the second image 630 may include pixels, brightness value 'b' of each of which is not less than reference brightness value 'r', from among effective pixels, pixels, brightness value 'b' of each of which is less than reference brightness value 'r', from among the effective pixels, and non-effective pixels, each of which does not include a pixel value (or brightness value 'b' of each of which is '0'). When an image 613 from enlarging a partial area 611 of the first image 610 is compared with an image 633 from enlarging a partial area 631 of the second image 630, the brightness value 'b' of each of some effective pixels may be modified from the reference brightness value 'r' or more to less than the reference brightness value 'r'.

Figure 7:
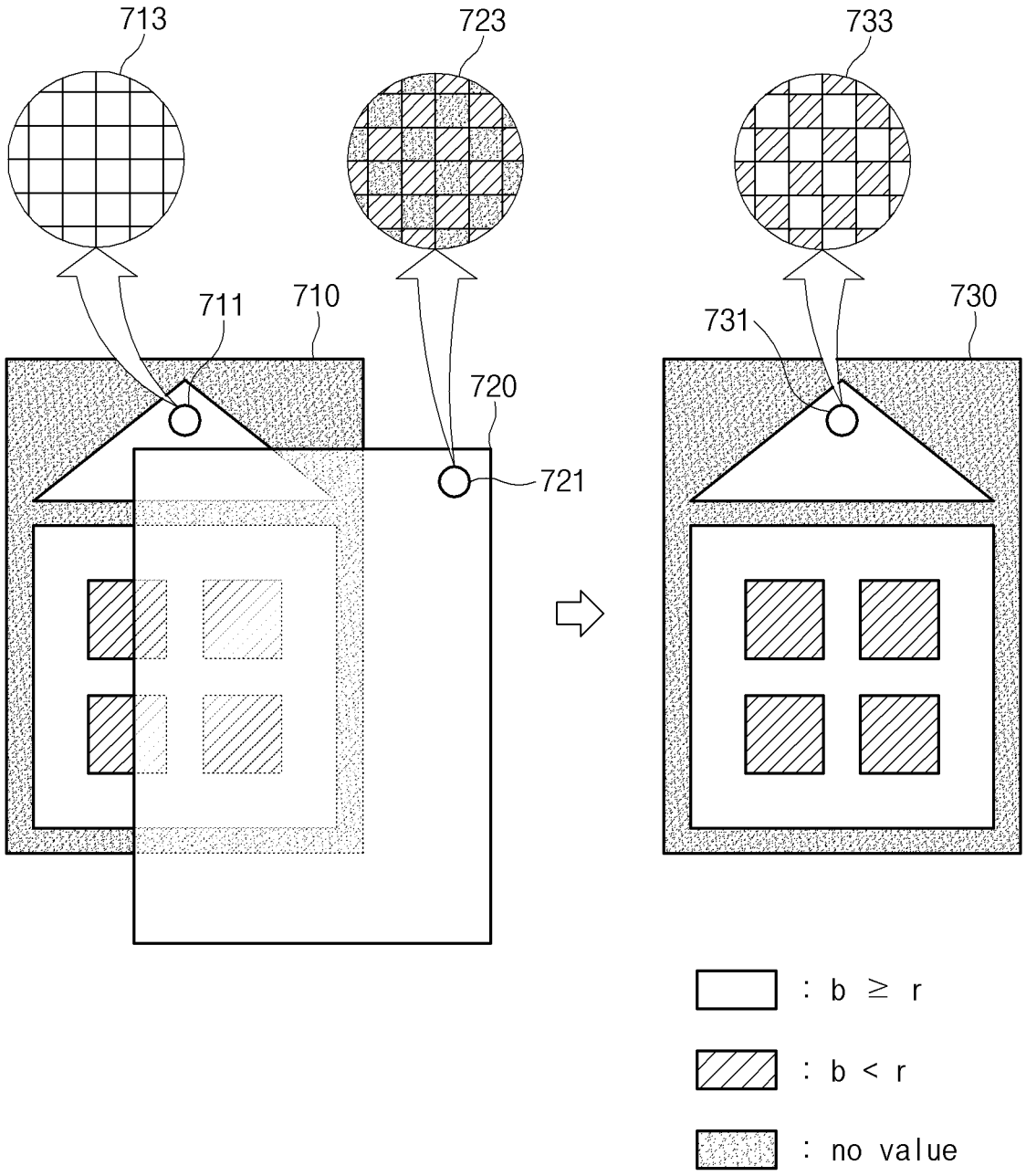
FIG. 7 is a view illustrating an image modified before an image is displayed on a display.

FIG. 7 is a view illustrating an image modified before an image is displayed on a display.

Referring to FIG. 7, the processor 440 may generate a first layer 710 and a second layer 720 disposed on the first layer 710. The first layer 710 may include an original image before modification. Referring to an image 723 from enlarging a partial area 721 of the second layer 720, the second layer 720 may include effective pixels (e.g., black pixels) of less than the specified brightness and non-effective pixels. An effective pixel (e.g., a black pixel) of less than the specified brightness and the non-effective pixel may be disposed in a specified pattern. According to an embodiment, the processor 440 may modify the image by overlapping with the second layer 720 on the first layer 710. When an image 713 from enlarging a partial area 711 of the first layer 710 is compared with an image 733 from enlarging a partial area 731 of the modified image 730, the brightness value 'b' of each of some effective pixels may be modified from the reference brightness value 'r' or more to less than the reference brightness value 'r'.

Figure 8:
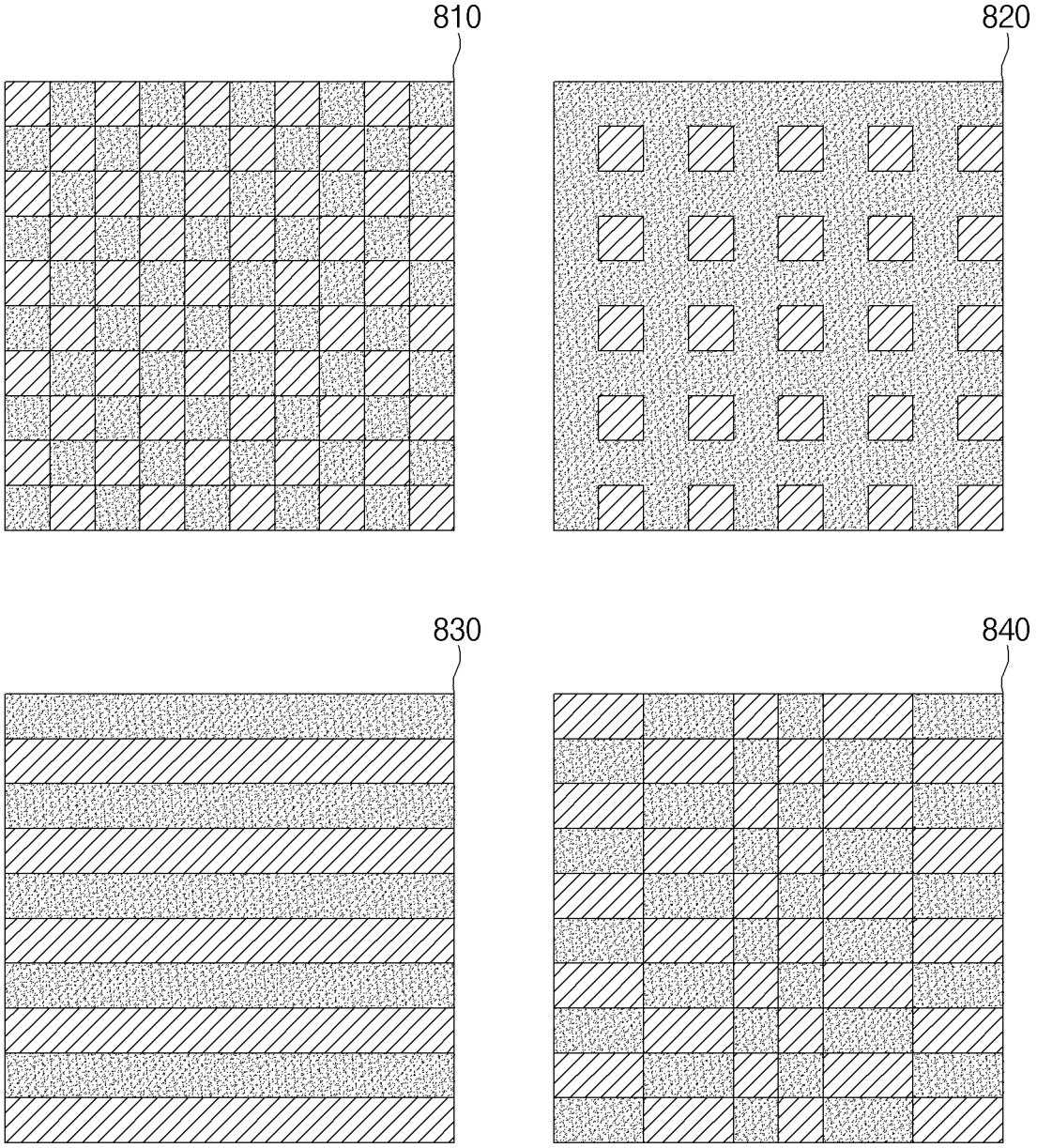
FIG. 8 is a view illustrating a pattern of a layer, according to various embodiments of the disclosure.

FIG. 8 is a view illustrating a pattern of a layer, according to various embodiments of the disclosure.

The various layers 810, 820, 830, and 840 illustrated in FIG. 8 may be used to modify an image before the image is displayed on the display 420. For example, the various layers 810, 820, 830, and 840 illustrated in FIG. 8 may correspond to the second layer 720 of FIG. 7.

The blinking of the image may occur because the pixels of the display 420 are frequently turned on/off, when the image modified using the various layers 810, 820, 830, and 840 illustrated in FIG. 8 is shifted. For example, when the image is shifted in the horizontal direction or the vertical direction in the case where the image is modified using the first layer 810 of FIG. 8, the blinking may occur. For another example, when the image is shifted in the horizontal direction, the vertical direction, and the diagonal direction in the case where the image is modified using the second layer 820 of FIG. 8, the blinking may occur. For still another example, when the image is shifted in the horizontal direction in the case where the image is modified using the third layer 830 of FIG. 8, the blinking may occur. For yet another example, when the image is shifted in the horizontal direction in the case where the image is modified using the fourth layer 840 of FIG. 8, the blinking may occur partially; when the image is shifted in the vertical direction in the case where the image is modified using the fourth layer 840 of FIG. 8, the blinking may occur as a whole.

Returning to FIG. 4, according to an embodiment, the processor 440 may select at least one pixel (i.e., a pixel of less than the reference brightness value) displayed on the display 420 at less than the specified brightness among the pixels included in the image. According to an embodiment, the processor 440 may select a pixel, which is displayed on a display at less than the specified brightness, from among the effective pixels of the image. For example, the processor 440 may select only an effective pixel other than a non-effective pixel among pixels displayed on the display 420 at less than the specified brightness. According to an embodiment, the processor 440 may select a pixel, which is positioned within a specified distance in a specified direction from a pixel displayed at a specified brightness or more, from among pixels displayed on the display 420 at less than the specified brightness. According to an embodiment, the processor 440 may determine the specified distance based on the arrangement forms of a plurality of types of pixels of the display 420 or the shift interval of the image. According to an embodiment, the processor 440 may determine the specified direction based on the shift direction of the image.

Figure 9A:
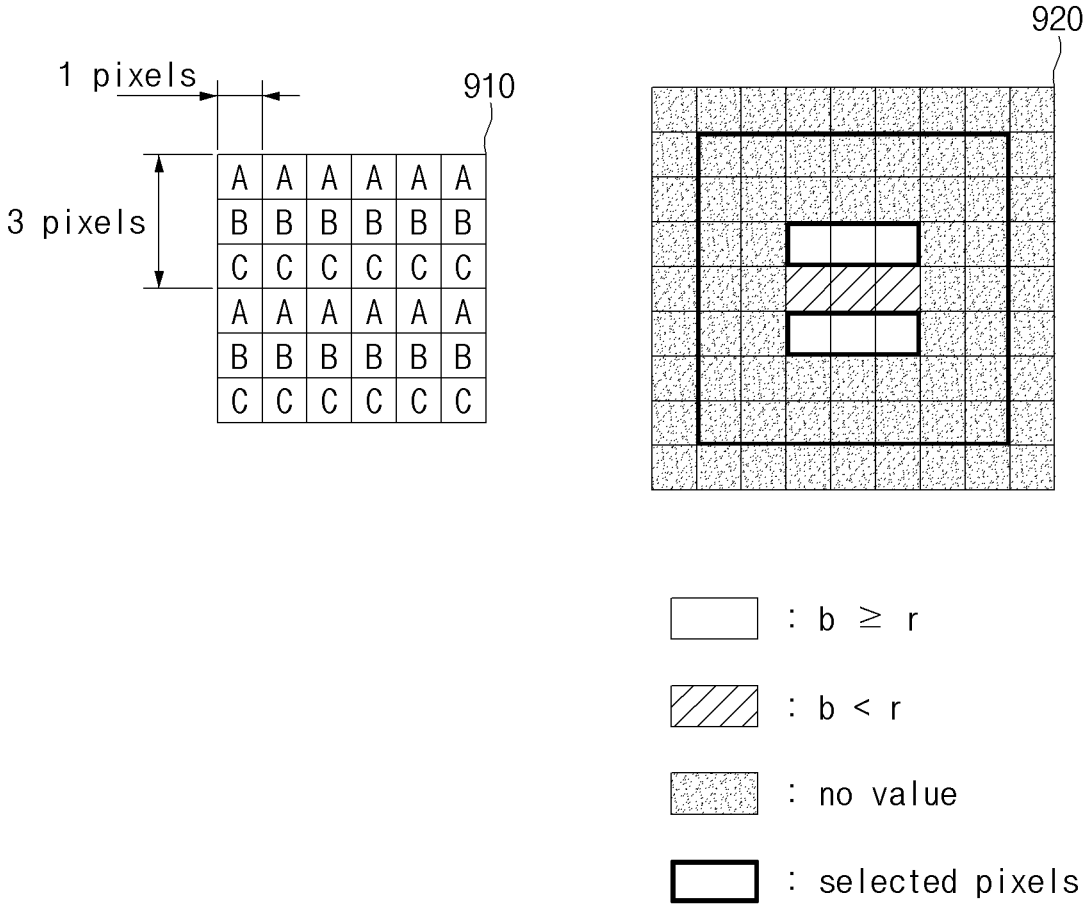
FIGS. 9A and 9B illustrate pixels selected depending on a pixel arrangement form of a display, according to various embodiments of the disclosure.
Figure 9B:
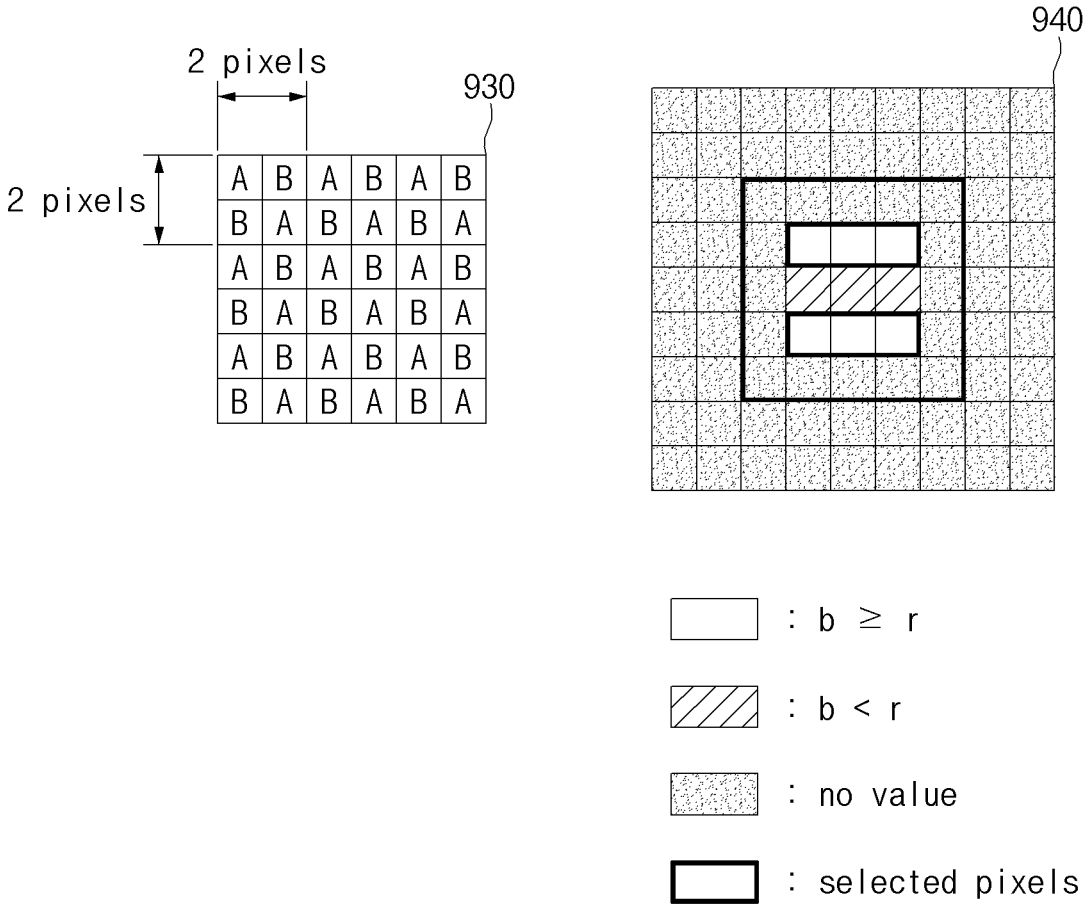

FIGS. 9A and 9B illustrate pixels selected depending on a pixel arrangement form of a display, according to various embodiments of the disclosure.

According to an embodiment, the processor 440 may determine a specified distance based on the arrangement forms of a plurality of types of pixels of the display 420. For example, the processor 440 may determine the specified distance based on the arrangement periods of the plurality of types of pixels.

Referring to FIG. 9A, a display panel 910 included in the display 420 may include a plurality of types of pixels depending on the arrangement of sub pixels included in each pixel. For example, the display panel 910 may include pixels of a first type 'A', a second type and a third type 'C'. For example, in the first type 'A' of pixel, sub pixels may be arranged in order Red, Green, and Blue. For example, in the second type 'B' of pixel, sub pixels may be arranged in order Blue, Red, and Green. For example, in the third type 'C' of pixel, sub pixels may be arranged in order Green, Blue, and Red. The first type 'A' of pixels are arranged in the first row of the display panel 910; the second type 'B' of pixels are arranged in the second row of the display panel 910; the third type 'C' of pixels are arranged in the third row of the display panel 910. According to an embodiment, the processor 440 may determine the value from subtracting one pixel from the maximum value of the arrangement periods of the display panel 910, as a specified distance. For example, the processor 440 may determine the specified distance as two pixels because the display panel 910 has the arrangement period of one pixel in the horizontal direction and the arrangement period of three pixels in the vertical direction.

According to an embodiment, an image 920 may include pixels, brightness value 'b' of each of which is not less than reference brightness value 'r', from among effective pixels, pixels, brightness value 'b' of each of which is less than reference brightness value 'r', from among the effective pixels, and non-effective pixels, each of which does not include a pixel value (or brightness value 'b' of each of which is '0'). The processor 440 may select pixels, which are positioned within two pixels from a pixel, the brightness value 'b' of which is not less than the reference brightness value 'r', from among pixels, the brightness value 'b' of each of which is less than the reference brightness value 'r'.

Referring to FIG. 9B, a display panel 930 included in the display 420 may include a plurality of types of pixels depending on the arrangement of sub pixels included in each pixel. For example, the display panel 930 may include pixels of the first type 'A' and the second type 'B'. For example, in the first type 'A' of pixel, sub pixels may be arranged in order Red, Green, and Blue. For example, in the second type 'B' of pixel, sub pixels may be arranged in order Blue, Red, and Green. The first type 'A' of pixel and the second type 'B' of pixel may be alternately arranged in unit of pixels. For example, the first type 'A' of pixel and the second type 'B' of pixel may be arranged in chessboard form. According to an embodiment, the processor 440 may determine the value from subtracting one pixel from the maximum value of the arrangement periods of the display panel 930, as a specified distance. For example, the processor 440 may determine the specified distance as one pixel because the display panel 930 has the arrangement period of two pixels in the horizontal direction and the arrangement period of two pixels in the vertical direction.

According to an embodiment, an image 940 may include pixels, brightness value 'b' of each of which is not less than reference brightness value 'r', from among effective pixels, pixels, brightness value 'b' of each of which is less than reference brightness value 'r', from among the effective pixels, and non-effective pixels, each of which does not include a pixel value (or brightness value 'b' of each of which is '0'). The processor 440 may select pixels, which are positioned within one pixel from a pixel, the brightness value 'b' of which is not less than the reference brightness value 'r', from among pixels, the brightness value 'b' of each of which is less than the reference brightness value 'r'.

Figure 10:
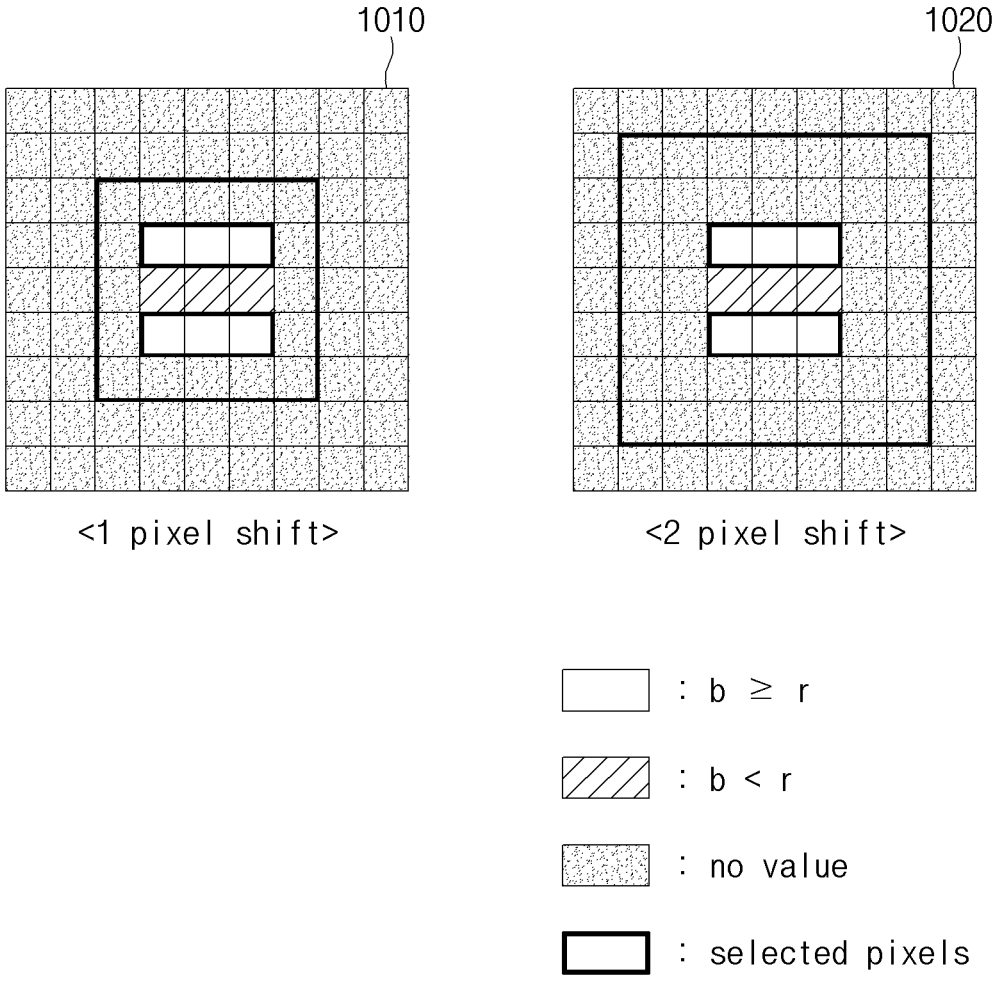
FIG. 10 illustrates pixels selected depending on a shift interval of an image, according to various embodiments of the disclosure.

FIG. 10 illustrates pixels selected depending on a shift interval of an image, according to various embodiments of the disclosure.

According to an embodiment, the processor 440 may determine the specified distance based on the shift interval of the image displayed on the display 420. For example, the processor 440 may determine the specified distance so as to correspond to the shift interval of the image.

According to an embodiment, when shifting the image displayed on the display 420, the processor 440 may continuously change the location of the image depending on the specified shift interval during a specified time. For example, the processor 440 may shift the image by one pixel or two pixels for each image frame.

Referring to FIG. 10, for example, when the shift interval of an image 1010 is one pixel, pixels, which are positioned within one pixel from a pixel, the brightness value 'b' of which is not less than the reference brightness value 'r', from among pixels, the brightness value 'b' of each of which is less than the reference brightness value 'r' may be selected. For another example, when the shift interval of an image 1020 is two pixels, the processor 440 may select pixels, which are positioned within two pixels from a pixel, the brightness value 'b' of which is not less than the reference brightness value 'r', from among pixels, the brightness value 'b' of each of which is less than the reference brightness value 'r'.

Figure 11:
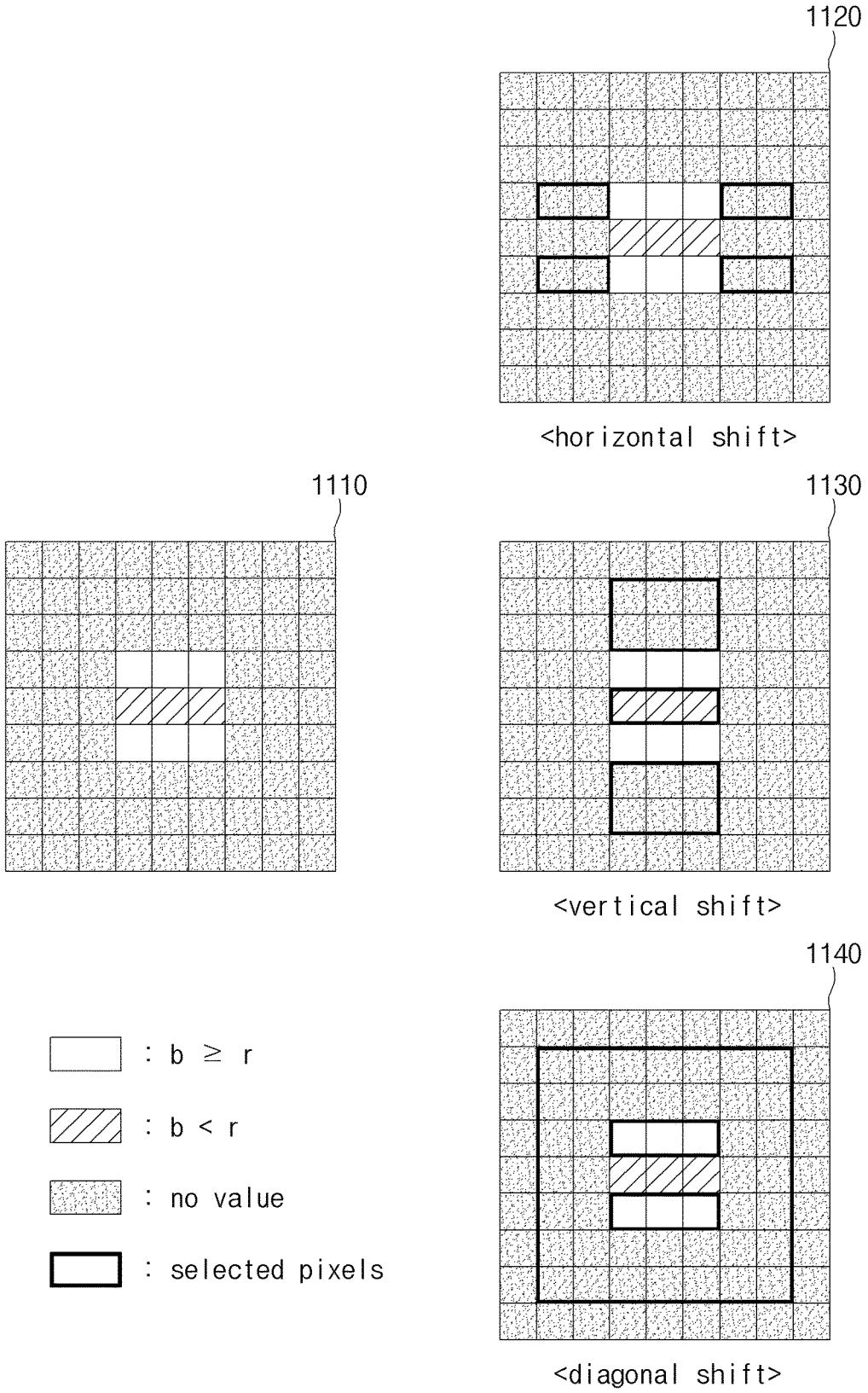
FIG. 11 illustrates pixels selected depending on a shift direction of an image, according to various embodiments of the disclosure.

FIG. 11 illustrates pixels selected depending on a shift direction of an image, according to various embodiments of the disclosure.

According to an embodiment, the processor 440 may determine the specified direction based on the shift direction of the image displayed on the display 420. For example, the processor 440 may determine the specified direction so as to correspond to the shift direction of the image. For example, the specified direction may include at least one of the width (or horizontal) direction, the height (or vertical) direction and the diagonal direction. For example, the diagonal direction may mean all directions except for the horizontal direction and the vertical direction.

A first image 1110 illustrated in FIG. 11 represents an image displayed on the display 420; a second image 1120 represents an area selected when the image 1110 shifts in the horizontal direction; a third image 1130 represents an area selected when the image 1110 shifts in the vertical direction; a fourth image 1140 represents an area selected when the image 1110 shifts in the diagonal direction. Referring to FIG. 11, the first image 1110 may include pixels, brightness value 'b' of each of which is not less than reference brightness value 'r', from among effective pixels, pixels, brightness value 'b' of each of which is less than reference brightness value 'r', from among the effective pixels, and non-effective pixels, each of which does not include a pixel value (or brightness value 'b' of each of which is '0'). According to an embodiment, the processor 440 may identify the shift direction of the image 1110 before shifting the image 1110. For example, the image 1110 may shift only in the horizontal direction or may shift only in the vertical direction. For another example, the image 1110 may shift in all the horizontal, vertical, and diagonal directions.

Referring to the second image 1120, when an image shifts in the horizontal direction, the processor 440 may select pixels, which are positioned within a specified interval (e.g., two pixels) in the horizontal direction from a pixel, the brightness value 'b' of which is not less than the reference brightness value 'r', from among pixels, the brightness value 'b' of each of which is less than the reference brightness value 'r'. Referring to the third image 1130, when an image shifts in the vertical direction, the processor 440 may select pixels, which are positioned within a specified interval (e.g., two pixels) in the vertical direction from a pixel, the brightness value 'b' of which is not less than the reference brightness value 'r', from among pixels, the brightness value 'b' of each of which is less than the reference brightness value 'r'. Referring to the fourth image 1140, when an image shifts in the diagonal direction, the processor 440 may select pixels, which are positioned within a specified interval (e.g., two pixels) in the diagonal direction from a pixel, the brightness value 'b' of which is not less than the reference brightness value 'r', from among pixels, the brightness value 'b' of each of which is less than the reference brightness value 'r'.

According to an embodiment, the processor 440 may increase the brightness of each of the selected pixels. For example, the processor 440 may increase the brightness of each of the selected pixels so as not to be less than the reference brightness value 'r'. Because a user recognizes that an image is changed when the brightness of each of the selected pixels is increased excessively, the brightness of each of the selected pixels may be changed to the extent that the user is substantially unaware.

Figure 12A:
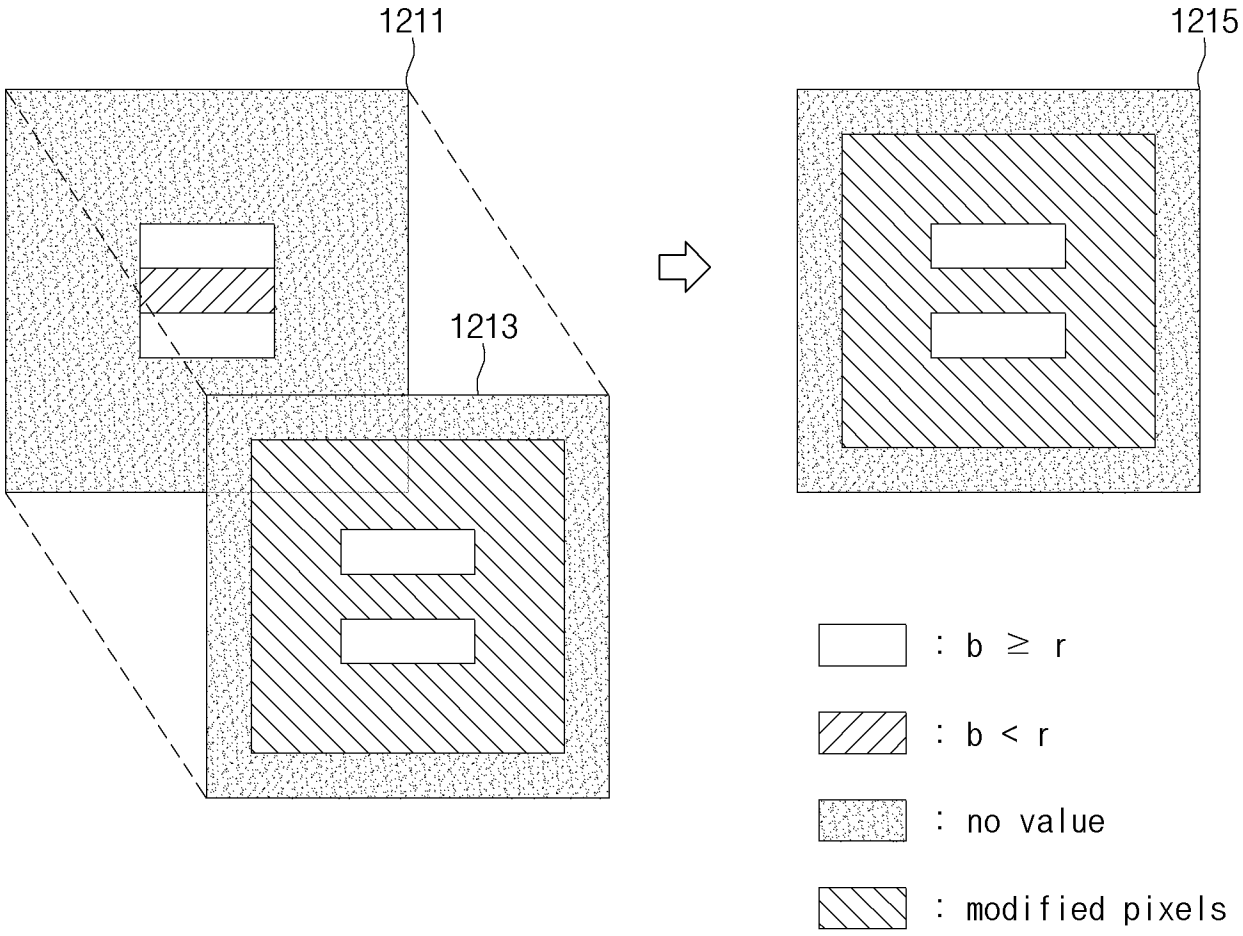
FIGS. 12A and 12B illustrate an embodiment in which brightness of an image is changed using a plurality of layers.
Figure 12B:
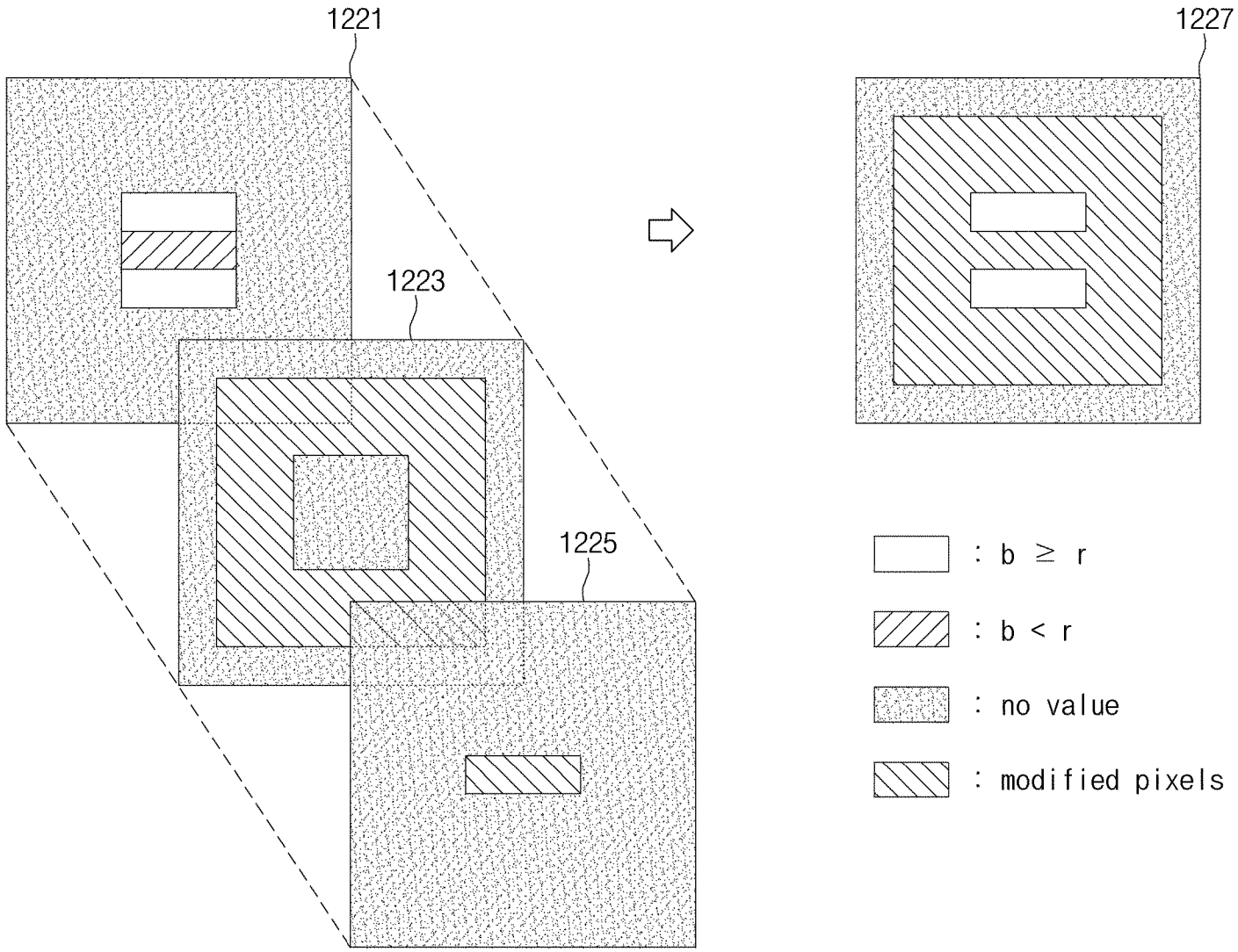

FIGS. 12A and 12B illustrate an embodiment in which brightness of an image is changed using a plurality of layers.

According to an embodiment, the processor 440 may increase the brightness of each of the selected pixels, using a plurality of layers. Referring to FIG. 12A, the processor 440 may generate a first layer 1211 and a second layer 1213 disposed on the first layer 1211. According to an embodiment, the first layer 1211 may include an image displayed on the display 420, and the second layer 1213 may include the selected at least one pixel. In the second layer 1213, the pixels other than the selected pixels may be non-effective pixels. According to an embodiment, the processor 440 may change the brightness of the selected at least one pixel by changing the pixel value of the second layer 1213. For example, the processor 440 may change the pixel value such that the selected pixels included in the second layer 1213 have the brightness not less than the reference brightness value 'r'. As the pixel value of the second layer 1213 is changed, the brightness of each of the selected pixels may be changed in the image 1215 where the first layer 1211 and the second layer 1213 overlap with each other.

According to an embodiment, the first layer 1211 corresponds to the first layer 710 of FIG. 7, and the second layer 1213 corresponds to the second layer 720 of FIG. 7. For example, for the purpose of preventing the burn-in phenomenon, the processor 440 may modify a part of the effective pixels of the image included in the first layer 1211, using the second layer 1213 so as to prevent the part of the effective pixels from being displayed on the display 420. When the image is modified to prevent the burn-in phenomenon, the first layer 1211 may include an image before modification. According to an embodiment, the processor 440 may change the brightness of the selected at least one pixel by changing the transparency of the second layer 1213. For example, when the processor 440 increases the transparency of the second layer 1213, the brightness of each of selected pixels may be changed by reflecting the pixel value of first layer 1211 to the image 1215 in which the first layer 1211 and the second layer 1213 overlap with each other as the transparency of the second layer 1213 changes.

Referring to FIG. 12B, the processor 440 may generate a first layer 1221, a second layer 1223 disposed on the first layer 1221, and a third layer 1225 disposed on the second layer 1223. When an image is modified to prevent the burn-in phenomenon, the first layer 1221 may include an image before modification. The second layer 1223 may include a non-effective pixel of the selected at least one pixel. The third layer 1225 may include an effective pixel of the selected at least one pixel.

According to an embodiment, the processor 440 may change the brightness of the selected at least one pixel by changing the pixel value of the second layer 1223 and changing the transparency of the third layer 1225. For example, the processor 440 may change the pixel value such that the selected non-effective pixels included in the second layer 1223 have the brightness not less than the reference brightness value 'r' and may increase the transparency of the third layer 1225. As the pixel value of the second layer 1223 is changed, the brightness of each of the selected non-effective pixels may be changed in an image 1227 where the first layer 1221, the second layer 1223, and the third layer 1225 overlap with one another. As the transparency of the third layer 1225 is changed, the brightness of each of the selected effective pixels among pixels selected by reflecting the pixel value of the first layer 1221 to the image 1227 where the first layer 1221, the second layer 1223, and the third layer 1225 overlap with one another may be changed.

According to an embodiment, when the brightness of each of the selected pixels increases, the processor 440 may shift the image displayed on the display 420. For example, the processor 440 may shift the image depending on the shift range, shift interval, or shift direction set in the image. According to an embodiment, when the shift of the image is completed, the processor 440 may decrease the brightness of each of the selected pixels to the original brightness before the image is shifted.

According to various embodiments of the disclosure, the blinking occurring when the image shifts may be prevented by shifting an image after changing the brightness of a part of pixels included in the image.

Figure 13:
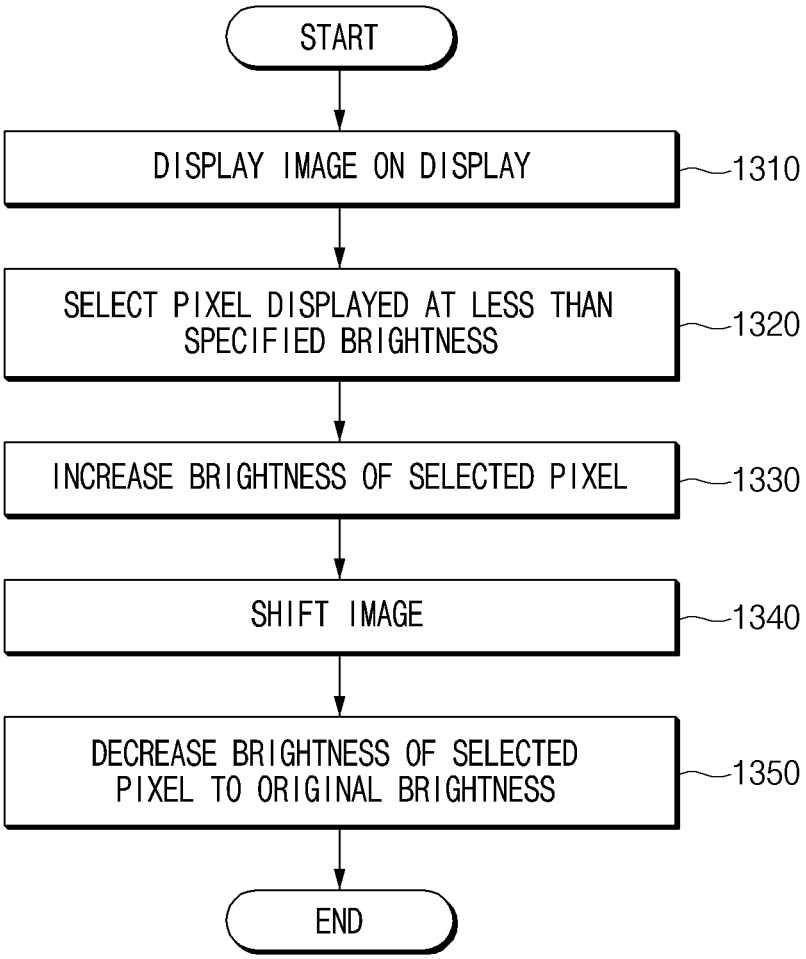
FIG. 13 is a flowchart illustrating an image displaying method of an electronic device, according to various embodiments of the disclosure.

FIG. 13 is a flowchart illustrating an image displaying method of an electronic device, according to various embodiments of the disclosure.

The flowchart illustrated in FIG. 13 may include operations that an electronic device (e.g., the electronic device 400 of FIG. 4) processes. Even though omitted below, detailed descriptions about the electronic device described with reference to FIGS. 1 to 12B may be applied to the flowchart shown in FIG. 13.

According to an embodiment, in operation 1310, an electronic device may display an image on a display (e.g., the display 420 of FIG. 4). According to an embodiment, the electronic device may display an image on the display while operating in a low power mode (e.g., sleep mode).

According to an embodiment, the electronic device may modify the image to be displayed before displaying the image. For example, the electronic device may divide the effective pixels included in the image into a plurality of groups (e.g., the first group and the second group) and may remove the pixel value of a part (e.g., first group) of the plurality of groups or may modify the pixel value to less than specified brightness (e.g., 0, 0, 0). According to an embodiment, the electronic device may generate a first layer including an original image and a second layer disposed on the first layer and including an effective pixel (e.g., black pixel) of less than specified brightness and a non-effective pixel. According to an embodiment, the electronic device may modify the image by overlapping the second layer on the first layer.

According to an embodiment, in operation 1320, the electronic device may select at least one pixel displayed at less than specified brightness. According to an embodiment, the electronic device may identify pixels, which are displayed on the display at less than the specified brightness, from among pixels included in the image. According to an embodiment, the electronic device may identify pixels displayed on the display at less than the specified brightness by comparing the brightness value of each of the pixels included in the image with a reference brightness value. For example, the electronic device may identify a pixel having a brightness value less than the reference brightness value (e.g., black pixel) among effective pixels and a non-effective pixel as a pixel displayed on a display at brightness lower than the specified brightness.

According to an embodiment, the electronic device may select a pixel, which is displayed on a display at less than the specified brightness, from among the effective pixels of the image. According to an embodiment, the electronic device may select a pixel, which is positioned within a specified distance in a specified direction from a pixel displayed at a specified brightness or more, from among pixels displayed on the display at less than the specified brightness. According to an embodiment, the electronic device may determine the specified distance based on the arrangement forms of a plurality of types of pixels of the display or the shift interval of the image. According to an embodiment, the electronic device may determine the specified direction based on the shift direction of the image.

According to an embodiment, in operation 1330, the electronic device may increase the brightness of the selected pixel. According to an embodiment, the electronic device may increase the brightness of each of the selected pixels, using a plurality of layers. For example, the electronic device may generate a first layer including an image and a second layer disposed on the first layer and including the selected at least one pixel. The electronic device may increase the brightness of each of the selected pixels by increasing the pixel value or transparency of the second layer. For another example, the electronic device may generate a first layer including an image, a second layer disposed on the first layer and including a part of the selected at least one pixel, and a third layer disposed on the second layer and including the remaining parts of the selected at least one pixel. The electronic device may increase the brightness of each of the selected pixels by increasing the pixel value of the second layer and increasing the transparency of the third layer.

According to an embodiment, in operation 1340, the electronic device may shift the image displayed on the display. For example, the electronic device may shift the image depending on the shift range, shift interval, or shift direction set in the image.

According to an embodiment, in operation 1350, the electronic device may decrease the brightness of the selected pixel to the original brightness, when the shift of the image is completed.

The term "module" used in the disclosure may represent, for example, a unit including one or more combinations of hardware, software and firmware. The term "module" may be interchangeably used with the terms "unit", "logic", "logical block", "part" and "circuit". The "module" may be a minimum unit of an integrated part or may be a part thereof. The "module" may be a minimum unit for performing one or more functions or a part thereof. The "module" may be implemented mechanically or electronically. For example, the "module" may include at least one of an application-specific IC (ASIC) chip, a field-programmable gate array (FPGA), and a programmable-logic device for performing some operations, which are known or will be developed.

At least a part of an apparatus (e.g., modules or functions thereof) or a method (e.g., operations) according to various embodiments may be, for example, implemented by instructions stored in a computer-readable storage media in the form of a program module. The instruction, when executed by a processor may cause the one or more processors to perform a function corresponding to the instruction.

A computer-readable recording medium may include a hard disk, a floppy disk, a magnetic media (e.g., a magnetic tape), an optical media (e.g., a compact disc read only memory (CD-ROM) and a digital versatile disc (DVD), a magneto-optical media (e.g., a floptical disk)), and hardware devices (e.g., a read only memory (ROM), a random access memory (RAM), or a flash memory). Also, the one or more instructions may contain a code made by a compiler or a code executable by an interpreter. The above hardware unit may be configured to operate via one or more software modules for performing an operation according to various embodiments, and vice versa.

A module or a program module according to various embodiments may include at least one of the above components, or a part of the above components may be omitted, or additional other components may be further included. Operations performed by a module, a program module, or other components according to various embodiments may be executed sequentially, in parallel, repeatedly, or in a heuristic method. In addition, some operations may be executed in different sequences or may be omitted. Alternatively, other operations may be added.

While the disclosure has been shown and described with reference to various embodiments thereof, it will be understood by those skilled in the art that various changes in form and details may be made therein without departing from the spirit and scope of the disclosure as defined by the appended claims and their equivalents.

The invention claimed is:

1. An electronic device comprising:
a memory configured to store an image;
a display; and
a processor,
wherein the processor is configured to:
display the image on the display;
select at least one pixel, which is displayed on the display at less than specified brightness, from among pixels included in the image;
increase brightness of the selected at least one pixel, while maintaining the brightness of each one of the pixels among the pixels included in the image having a brightness that is not less than the specified brightness; and
shift the image displayed on the display.

2. The electronic device of claim 1, wherein the processor is configured to:
when the shift of the image is completed, decrease the brightness of the selected at least one pixel to an original brightness.

3. The electronic device of claim 1, wherein the processor is configured to:
select a pixel, which is displayed on the display at less than the specified brightness, from among effective pixels of the image.

4. An electronic device comprising:
a memory configured to store an image;
a display; and
a processor,
wherein the processor is configured to:
display the image on the display;

select a pixel, which is positioned within a specified distance in a specified direction from a pixel displayed at a specified brightness or more, from among pixels displayed on the display at less than the specified brightness;

increase brightness of the selected pixel; and shift the image displayed on the display.

5. The electronic device of claim 4, wherein the display includes a plurality of types of pixels depending on an arrangement form of a sub pixel, and wherein the processor is configured to:

determine the specified distance based on a shift interval of the image or an arrangement form of the plurality of types of pixels.

6. The electronic device of claim 4, wherein the processor is configured to:

determine the specified direction based on a shift direction of the image.

7. The electronic device of claim 1, wherein the processor is configured to:

generate a first layer including the image and a second layer disposed on the first layer and including the selected at least one pixel; and increase the brightness of the selected at least one pixel by increasing a pixel value or transparency of the second layer.

8. The electronic device of claim 1, wherein the processor is configured to:

generate a first layer including the image, a second layer disposed on the first layer and including a part of the selected at least one pixel, and a third layer disposed on the second layer and including the remaining parts of the selected at least one pixel; and increase the brightness of the selected at least one pixel by increasing a pixel value of the second layer and transparency of the third layer.

9. The electronic device of claim 1, wherein the processor is configured to:

display the image in a state where the display operates in a low power mode.

10. An image displaying method of an electronic device, the method comprising:

displaying an image on a display;

selecting at least one pixel, which is displayed on the display at less than specified brightness, from among pixels included in the image;

increasing brightness of the selected at least one pixel, while maintaining the brightness of each one of the pixels among the pixels included in the image having a brightness that is not less than the specified brightness; and shifting the image displayed on the display.

11. The method of claim 10, further comprising:

when the shifting of the image is completed, decreasing the brightness of the selected at least one pixel to an original brightness.

12. The method of claim 10, wherein the selecting of the at least one pixel includes:

selecting a pixel, which is displayed on the display at less than the specified brightness, from among effective pixels of the image.

13. An image displaying method of an electronic device, the method comprising:

displaying an image on a display;

selecting a pixel, which is positioned within a specified distance in a specified direction from a pixel displayed at a specified brightness or more, from among pixels displayed on the display at less than the specified brightness;

increasing brightness of the selected pixel; and shifting the image displayed on the display.

14. The method of claim 13, wherein the display includes a plurality of types of pixels depending on an arrangement form of a sub pixel, and wherein the specified distance is determined based on a shift interval of the image or an arrangement form of the plurality of types of pixels.

15. The method of claim 13, wherein the specified direction is determined based on a shift direction of the image.

* * * * *